US010677114B2

(12) United States Patent
Takada et al.

(10) Patent No.: US 10,677,114 B2
(45) Date of Patent: Jun. 9, 2020

(54) VARIABLE VALVE OPERATING DEVICE FOR INTERNAL COMBUSTION ENGINE

(71) Applicant: HONDA MOTOR CO., LTD., Minato-Ku, Tokyo (JP)

(72) Inventors: Yoshihiro Takada, Wako (JP); Dai Kataoka, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 16/484,261

(22) PCT Filed: Feb. 7, 2018

(86) PCT No.: PCT/JP2018/004245
§ 371 (c)(1),
(2) Date: Aug. 7, 2019

(87) PCT Pub. No.: WO2018/147337
PCT Pub. Date: Aug. 16, 2018

(65) Prior Publication Data

US 2020/0003090 A1 Jan. 2, 2020

(30) Foreign Application Priority Data

Feb. 13, 2017 (JP) ..... 2017-023738

(51) Int. Cl.
*F01L 1/34* (2006.01)
*F01L 13/00* (2006.01)
(Continued)

(52) U.S. Cl.
CPC ..... *F01L 13/0036* (2013.01); *F01L 1/053* (2013.01); *F01L 1/026* (2013.01); *F01L 9/02* (2013.01);
(Continued)

(58) Field of Classification Search
CPC ... F01L 1/053; F01L 1/04; F01L 1/026; F01L 13/0036; F01L 13/00; F01L 2001/0537; F01L 9/02; F01L 2013/0052
See application file for complete search history.

(56) References Cited

U.S. PATENT DOCUMENTS 8,584,639 B2 * 11/2013 Elendt ..... F01L 13/0036 123/90.18
2015/0101552 A1 4/2015 Choi
(Continued)

FOREIGN PATENT DOCUMENTS

JP 3980699 B2 9/2007
JP 2013-239538 A 11/2013

*Primary Examiner* — Zelalem Eshete
(74) *Attorney, Agent, or Firm* — Carrier Blackman & Associates, P.C.; Joseph P. Carrier; William D. Blackman

(57) ABSTRACT

A variable valve operating device for an internal combustion engine includes a cam carrier supported on a camshaft and shifting switching pins that are advanced into and retracted out of shift lead grooves defined in the cam carrier. The shift lead grooves include shift groove side walls having shift groove side wall surfaces from shift starting inflection regions of the cam carrier to shift ending inflection regions thereof. The shift groove side walls include particular shift groove side walls extending from axial positions of the shift starting inflection regions toward shift intermediate regions and also extending from circumferential positions of the shift intermediate regions disposed between the shift starting inflection regions and the shift ending inflection regions toward the shift starting inflection regions. The side walls have slanted outer circumferential surfaces extending from the circumferential positions progressively deeper toward groove bottom surfaces and reaching the shift starting inflection regions.

11 Claims, 19 Drawing Sheets

(51) Int. Cl.

| | |
|---|---|
| ***F01L 1/053*** | (2006.01) |
| *F01L 1/02* | (2006.01) |
| *F01L 9/02* | (2006.01) |

(52) U.S. Cl.
CPC ..... *F01L 2001/0537* (2013.01); *F01L 2013/0052* (2013.01)

(56) References Cited

U.S. PATENT DOCUMENTS

| | | | |
|---|---|---|---|
| 2016/0090875 | A1 | 3/2016 | Choi |
| 2016/0160696 | A1 | 6/2016 | Han |

* cited by examiner

VARIABLE VALVE OPERATING DEVICE FOR INTERNAL COMBUSTION ENGINE

TECHNICAL FIELD

The present invention relates to a variable valve operating device for switching between valve operating characteristics of an internal combustion engine.

BACKGROUND ART

There is known a variable valve operating device in which a cam carrier having on an outer circumferential surface thereof a plurality of cam lobes having different cam profiles that determine valve operating characteristics is axially slidably, but relatively nonrotatably, fitted over a camshaft, and the cam carrier is axially moved to cause different cam lobes to act on a valve for thereby changing valve operating characteristics (see, for example, Patent Document 1).

PRIOR ART DOCUMENT

Patent Document

Patent Document 1: JP 3980699 B

In the variable valve operating device disclosed in Patent Document 1, the cam carrier (cam) slidably fitted over the camshaft has a shift lead groove (stroke curve) defined therein as a helical groove, and a switching pin (operating pin) engages in the shift lead groove for axially guiding and moving the cam carrier while the cam carrier is rotating, changing the cams acting on an internal combustion engine valve (gas exchange valve).

The switching pin, which operates as a fluid pressure piston, projects under a fluid pressure to have its distal end entering and engaging in the shift lead groove being rotated. When the switching pin engages in the shift lead groove being rotated, the cam carrier is axially shifted while rotating.

SUMMARY OF THE INVENTION

Underlying Problems to be Solved by the Invention

The switching pin that engages in the shift lead groove axially shifts the cam carrier by slidingly contacting the curved wall surface of one of groove side walls on both sides of the shift lead groove.

Therefore, when the switching pin enters the shift lead groove that is defined in an outer circumferential surface of the cam carrier rotating at high speed, the switching pin obliquely hits and contacts the curved wall surface of one of the groove side walls of the shift lead groove.

If the switching pin hits and contacts a shift groove side wall surface of the shift lead groove after having sufficiently entered the shift lead groove, the switching pin has a sufficiently long portion near its distal end, bearing the shift groove side wall surface. As the switching pin has a large area held in sliding contact with the shift groove side wall surface, the load on the switching pin is small, allowing the switching pin to engage in the shift lead groove without undue stress for smoothly shifting the cam carrier.

However, if the switching pin hits and contacts the shift groove side wall surface of the shift lead groove earlier when the switching pin starts to enter the shift lead groove, the switching pin may have a short small portion near its distal end, bearing the shift groove side wall surface. Then, the distal end of the switching pin may undergo an undue intensive load imposed thereon, putting the switching pin under large stress. The switching pin may occasionally behave in a manner not preferable for smoothly shifting the cam carrier, e.g., may be flicked off.

The present invention has been made in view of the above shortcomings. It is an object of the present invention to provide a variable valve operating device for an internal combustion engine in which a switching pin can shift a cam carrier smoothly under a small mechanical load imposed thereon irrespectively of a timing at which the switching pin enters a shift lead groove defined in the cam carrier.

Means to Solve the Problems

In order to achieve the above object, there is provided in accordance with the present invention a variable valve operating device for an internal combustion engine, including a camshaft rotatably supported in a cylinder head of the internal combustion engine, a cam carrier in the form of a tubular member axially movably, but relatively nonrotatably fitted over an outer circumferential surface of the camshaft, the cam carrier having a lead groove tubular portion integrally therewith which has on an outer circumferential surface a plurality of cam lobes having different cam profiles and disposed axially adjacent to each other and shift lead grooves in the form of channels defined by groove bottom surfaces and groove side wall surfaces on both sides of the groove bottom surfaces, switching pins that can be advanced into and retracted out of the shift lead grooves, and a cam switching mechanism for axially guiding and shifting the cam carrier while the cam carrier is rotating to switch between the cam lobes for acting on valves of the internal combustion engine when the switching pins are advanced under the bias of springs to engage into the shift lead grooves. Of the shift lead grooves in the lead groove tubular portion, the groove side wall surfaces that are pressed by the switching pins include shift groove side wall surfaces from shift starting inflection regions where the cam carrier starts its shifting movement to shift ending inflection regions where the cam carrier ends its shifting movement, the shift intermediate regions are disposed in predetermined regions from the shift starting inflection regions to the shift ending inflection regions on the shift groove side wall surfaces, the lead groove tubular portion includes shift groove side walls having the shift groove side wall surfaces as wall surfaces thereof circumferentially between the shift starting inflection regions and the shift ending inflection regions, the shift groove side walls include particular shift groove side walls disposed in an area extending axially from axial positions of the shift starting inflection regions toward the shift intermediate regions and also extending circumferentially from circumferential positions of the shift intermediate regions toward the shift starting inflection regions, and the particular shift groove side walls have slanted outer circumferential surfaces extending circumferentially from the circumferential positions of the shift intermediate regions progressively deeper toward the groove bottom surfaces and reaching the shift starting inflection regions.

With this arrangement, after the switching pins that have traveled enter the shift lead grooves to a depth equal to or larger than the depth of the shift starting inflection regions, when the shift starting inflection regions of the shift groove side wall surfaces reach the switching pins, the switching pins impinge upon the shift groove side wall surfaces of the particular shift groove side walls. Immediately after the switching pins have impinged upon the shift groove side wall surfaces, the area of sliding contact of the switching pins with the shift groove side wall surfaces quickly increases in addition to the movement of the switching pins due to the slanted outer circumferential surfaces of the particular shift groove side walls. Therefore, no undue intensive load is imposed on the distal ends of the switching pins, so that the load on the switching pins may be small and the switching pins are prevented from behaving undesirably. The switching pins can thus smoothly guide and shift the cam carrier axially.

Before the switching pins that have traveled enter the shift lead grooves to the depth of the shift starting inflection regions, when the shift starting inflection regions of the shift groove side wall surfaces reach the switching pins, the switching pins are positioned along a plane axially perpendicular to the axial position of the shift starting inflection regions on the shift groove side walls that are rotating, but do not impinge upon the shift groove side wall surfaces. Instead, the distal ends of the switching pins are brought into sliding contact with the slanted outer circumferential surfaces of the particular shift groove side walls. The switching pins are retracted against the springs and smoothly slide up the slanted outer circumferential surfaces. The switching pins ride over the outer circumferential surfaces of the shift groove side walls and then enter the shift lead grooves again. Therefore, in a next cycle, when the switching pins have sufficiently entered the shift lead grooves, the shift starting inflection regions reach the switching pins, causing the cam carrier to be shifted smoothly, as described above.

Since the distal ends of the switching pins do not impinge upon the shift groove side wall surfaces, but are brought into sliding contact with the slanted outer circumferential surfaces of the particular shift groove side walls under the bias of the springs, no undue intensive load is imposed on the distal ends of the switching pins, so that the load on the switching pins is small.

As described above, the variable valve operating device can reduce the load on the switching pins at all times and smoothly shift the cam carrier irrespectively of the timing at which the switching pins enter the shift lead grooves in the cam carrier, causing the different cam lobes to act on the valves for smoothly changing valve operating characteristics.

In the above arrangement, the lead groove tubular portion of the cam carrier may have a steady lead groove disposed in a fixed axial position and extending fully circumferentially, the steady lead groove being arrayed axially adjacent to the shift lead grooves, and the shift lead grooves may be joined to the steady lead groove at the shift ending inflection regions.

With this arrangement, inasmuch as the switching pins that have engaged in the shift lead grooves and shifted the cam carrier are transferred and engage into the steady lead groove, it is not necessary for each of the two shift lead grooves for different shifting directions to have respective steady lead grooves, but the single common steady lead groove may be disposed between the two shift lead grooves, so that the axial width of the lead groove tubular portion is minimized to prevent the cam carrier from increasing in size.

When the steady lead groove in the lead groove tubular portion is to be machined circumferentially, the slanted outer circumferential surfaces of the particular shift groove side walls at corners of the shift groove side walls having curved shift groove side walls can simultaneously be machined circumferentially, resulting in a reduction in the manufacturing cost.

In the above arrangement, the shift intermediate regions may be disposed in an axial position that is axially spaced from the shift starting inflection regions by a distance that is equal to or larger than one-half of the lead groove width of the shift lead grooves.

With this arrangement, as the shift intermediate regions are in an axial position that is axially spaced from the shift starting inflection regions by a distance that is equal to or larger than one-half of the lead groove width of the shift lead grooves, the axial width of the slanted outer circumferential surfaces, which are shaped generally as a right-angled triangle, of the particular shift groove side walls is progressively increased to a width that is equal to or larger than about one-half of the lead groove width, reducing the possibility that the switching pins that have moved onto the slanted outer circumferential surfaces may fall off the slanted outer circumferential surfaces. Thus, it is possible to avoid, as much as possible, an intensive load that would otherwise be applied to the edges of the distal ends of the switching pins if the switching pins fall off the slanted outer circumferential surfaces, thereby reducing the load on the second switching pin.

In the above arrangement, a depth of the slanted outer circumferential surfaces at the shift starting inflection regions from the outer circumferential surface of the lead groove tubular portion may be equal to or larger than one-half of the lead groove depth.

With this arrangement, as the depth of the slanted outer circumferential surfaces at the shift starting inflection regions from the outer circumferential surface of the lead groove tubular portion is equal to or larger than one-half of the lead groove depth, the angle at which the slanted outer circumferential surfaces of the particular shift groove side walls are slanted can easily be set to a large value. Therefore, when the shift starting inflection regions of the shift groove side wall surfaces of the shift lead grooves that are rotating have reached the switching pins, even if the shift groove side wall surfaces impinge upon the distal ends of the switching pins, since the slanted outer circumferential surfaces S of the particular shift groove side walls Tab are steeply slanted in addition to the movement of the switching pins immediately after the shift groove side wall surfaces have impinged upon the distal ends of the switching pins, the area of sliding contact of the switching pins with the shift groove side wall surfaces Faz is quickly increased, so that the load on the switching pins may be reduced.

In the above arrangement, the shift groove side wall surfaces may be disposed on the lead groove tubular portion for slidingly contacting the switching pins in an angular range of the cam carrier where the common base circle of the cam lobes which have different cam profiles act on the valve.

With this arrangement, the shift groove side wall surfaces are disposed for slidingly contacting the switching pins in an angular range of the cam carrier where the common base circle of the cam lobes which have different cam profiles acts on the valve. Therefore, while the common base circle of the cam lobes is acting on the valves, the cam carrier can be shifted without fail.

Advantageous Effects of the Invention

According to the present invention, of the shift groove side walls having the shift groove side wall surfaces for shifting the cam carrier with the switching pins on the lead groove tubular portion, the particular shift groove side walls extending axially from the axial positions of the shift starting inflection regions toward the shift groove side wall surfaces and also extending circumferentially from the circumferential positions of the shift intermediate regions between the shift starting inflection regions and the shift ending inflection regions of the shift groove side wall surfaces toward the shift groove side wall surfaces have the slanted outer circumferential surfaces extending circumferentially from the circumferential positions of the shift intermediate regions progressively deeper toward the lead groove bottom surfaces and reaching the shift starting inflection regions. Therefore, the variable valve operating device can reduce the load on the switching pins at all times and smoothly shift the cam carrier irrespectively of the timing at which the switching pins enter the shift lead grooves in the cam carrier, causing the different cam lobes to act on the valves for smoothly changing valve operating characteristics.

MODE FOR CARRYING OUT THE INVENTION

Figure 1:
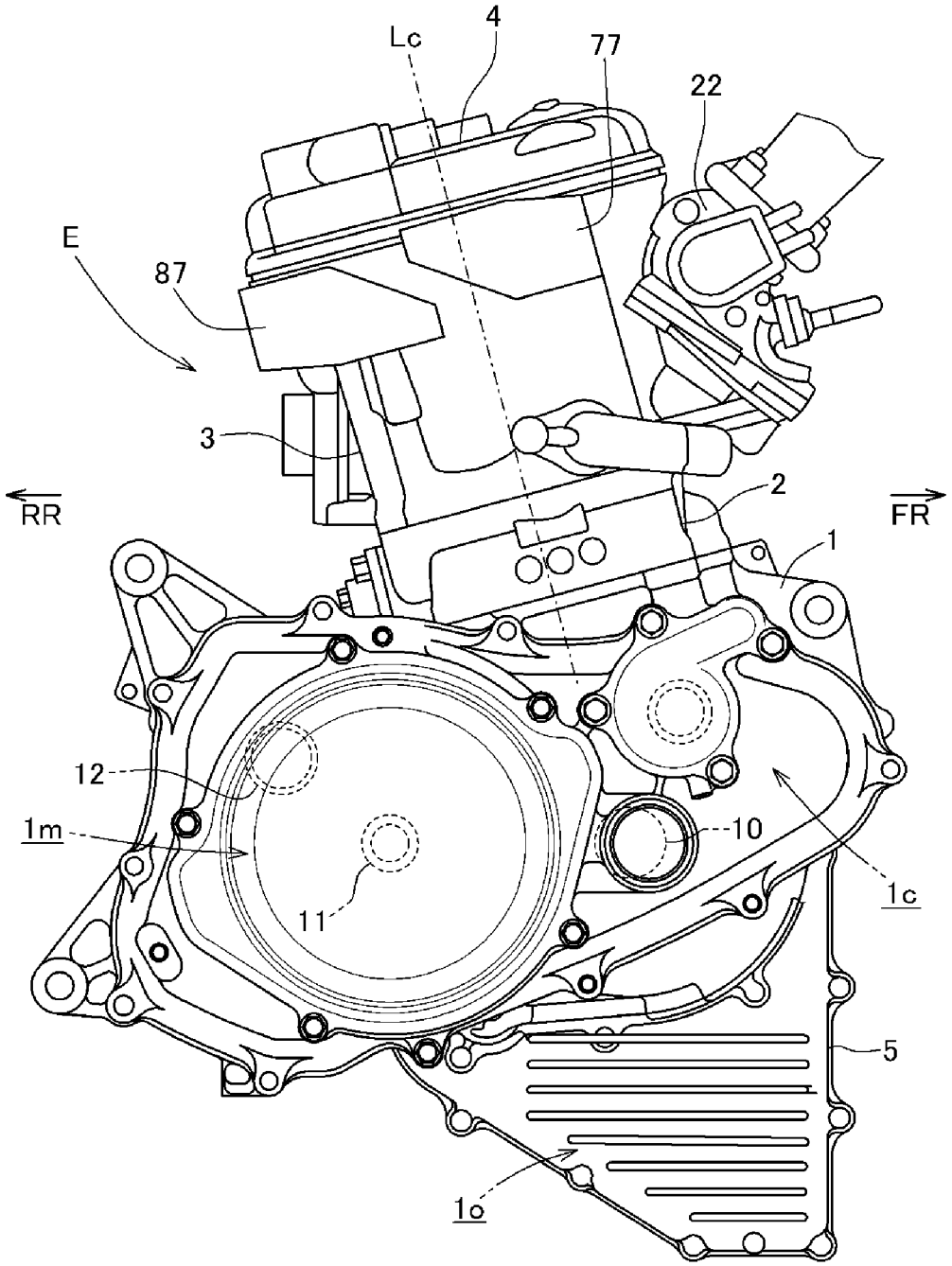
FIG. 1 is a right side elevational view of an internal combustion engine incorporating a variable valve operating device according to a first embodiment of the present invention.

An embodiment of the present invention will hereinafter be described with reference to FIGS. 1 through 21.

An internal combustion engine E incorporating a variable valve operating device 40 (see FIG. 3) according to the present embodiment is a water-cooled single-cylinder four-stroke internal combustion engine and is mounted on a motorcycle, not illustrated, that includes a four-valve double overhead camshaft (DOHC) valve operating mechanism.

In the specification of the present invention, forward, rearward, leftward, and rightward directions are defined in accordance with the normal orientations of the motorcycle where the forward direction is the direction along which the motorcycle moves straight ahead. In the drawings, the reference characters FR represent a forward direction, RR a rearward direction, LH a leftward direction, and RH a rightward direction.

Figure 2:
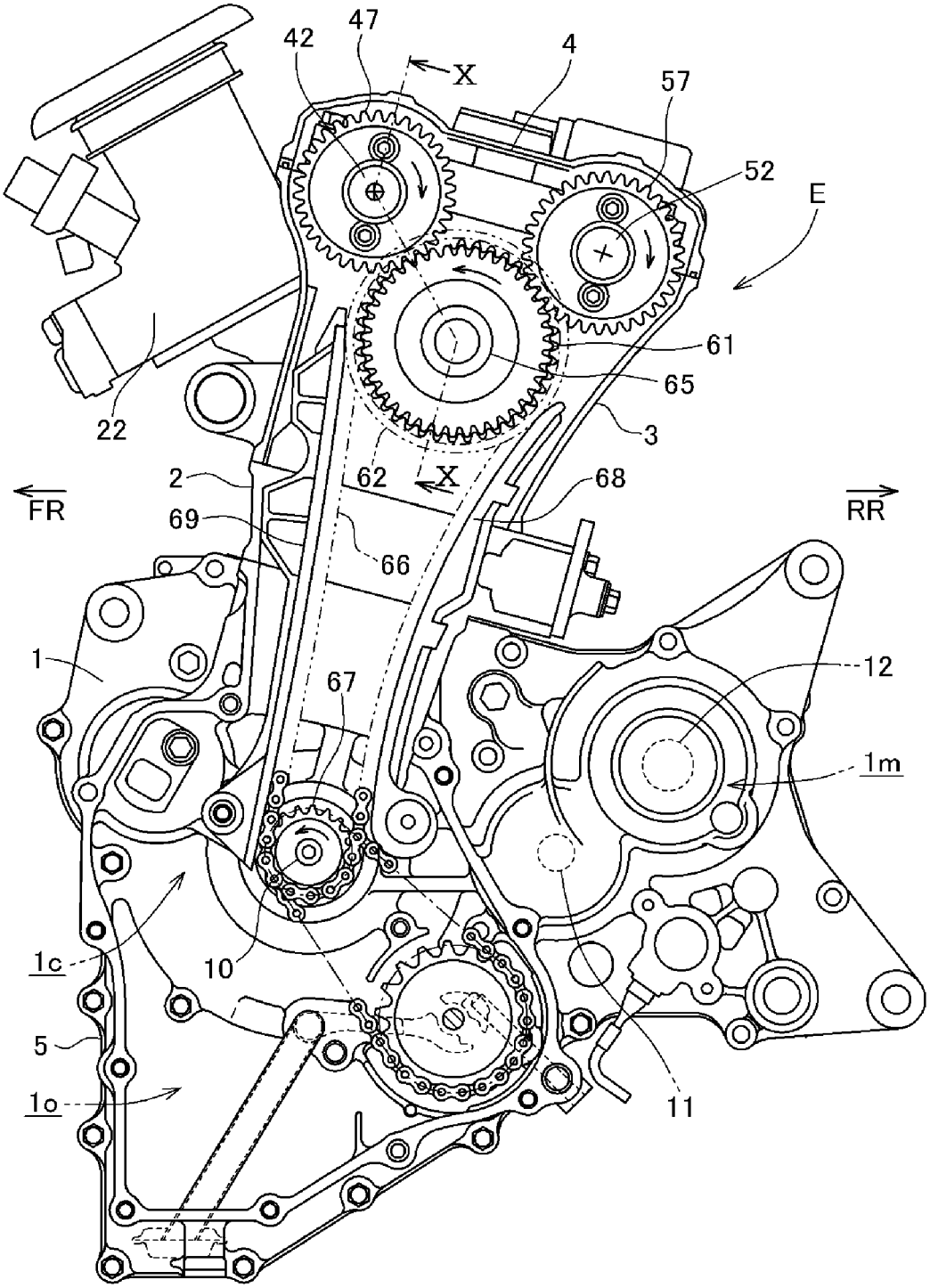
FIG. 2 is a left side elevational view of the internal combustion engine whose cover is partly removed.
Figure 3:
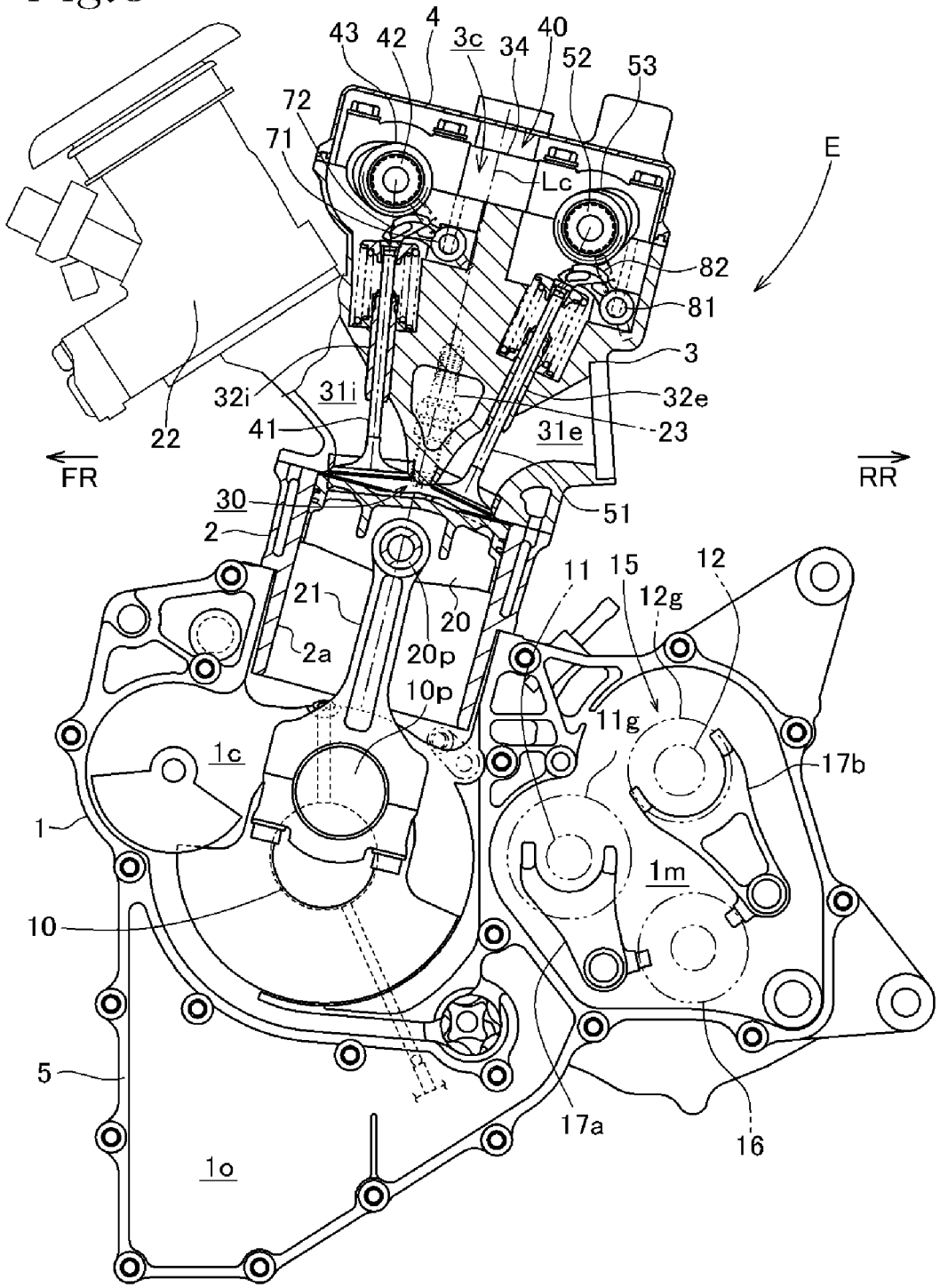
FIG. 3 is a left side elevational view of the internal combustion engine, partly omitted from illustration and viewed in a cross section along a plane across valves.

As illustrated in FIGS. 1 through 3, the internal combustion engine E has an engine body including a crank chamber 1*c* defined in a crankcase 1, a cylinder block 2 that has a single cylinder 2*a* disposed therein on the crank chamber 1*c*, a cylinder head 3 coupled to an upper portion of the cylinder block 2 with a gasket interposed therebetween, and a cylinder head cover 4 covering an upper portion of the cylinder head 3.

The cylinder 2*a* of the cylinder block 2 has a central axis as a cylinder axis Lc slightly inclined rearwardly. The cylinder block 2, the cylinder head 3, and the cylinder head cover 4 that are stacked on the crankcase 1 extend upwardly in a posture that is inclined slightly rearwardly.

An oil pan 5 defining an oil pan chamber 1*o* extends downwardly from the crankcase 1.

The crankcase 1 has a transmission chamber 1*m* defined therein that houses therein a transmission M having a main shaft 11 and a countershaft 12 that are oriented parallel to a crankshaft 10 in leftward and rightward horizontal directions (see FIG. 3). The countershaft 12 extends leftwardly through the crankcase 1 and projects outwardly therefrom as an output shaft.

The transmission M that is disposed in the transmission chamber 1*m* behind the crank chamber 1*c* includes the main shaft 11 and the countershaft 12 on which a main gear group 11*g* and a counter gear group 12*g* are respectively disposed, and a transmission switching mechanism 15 having a shift drum 16 and a shift forks 17*a* and 17*b* that are operated by a transmission operating mechanism (see FIG. 3).

Referring to FIG. 3, a piston 20 that is reciprocally movable in the cylinder 2*a* in the cylinder block 2 and the crankshaft 10 are interconnected by a connecting rod 21 whose both ends are supported respectively by a piston pin 20*p* and a crankpin 10*p*, making up a crank mechanism.

The internal combustion engine E includes a variable valve operating device 40 for a four-valve DOHC structure.

Referring to FIG. 3, the cylinder head 3 has a combustion chamber 30 defined therein in association with the cylinder 2*a* and facing the top surface of the piston 20 along the cylinder axis, two intake ports 31*i* defined therein that are curved forwardly and extend obliquely upwardly, and two exhaust ports 31*e* defined therein that are curved and extend rearwardly.

The two intake ports 31*i* have respective upstream portions joined together into an intake passageway as an extension where a throttle body 22 is disposed. The throttle body 22 is open on a side thereof upstream of the intake passageway.

The combustion chamber 30 has a ceiling wall with a spark ignition plug 23 mounted centrally thereon which has a tip end facing the combustion chamber 30.

Intake valves 41 and exhaust valves 51 are slidably supported in respective valve guides 32*i* and 32*e* that are integrally fitted in the cylinder head 3. The intake valves 41 and the exhaust valves 51 are actuated by the variable valve operating device 40 included in the internal combustion engine E for opening and closing intake openings of the intake ports 31*i* and exhaust openings of the exhaust ports 31*e* in synchronism with rotation of the crankshaft 10.

The variable valve operating device 40 is disposed in a valve operating chamber 3*c* defined by the cylinder head 3 and the cylinder head cover 4.

Figure 6:
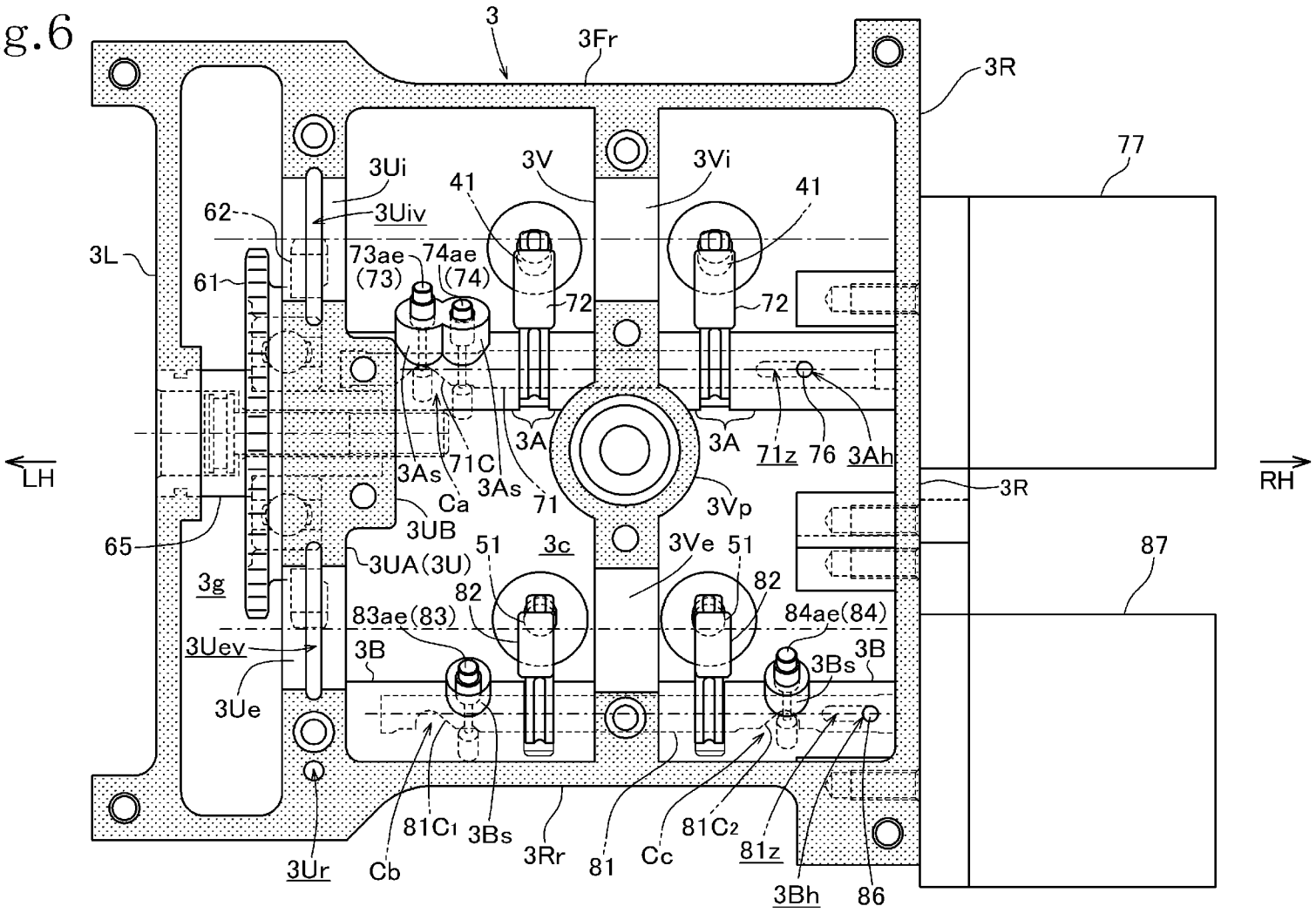
FIG. 6 is a plan view of the cylinder head with cam carriers and camshafts further removed.

Referring to FIG. 6, which is a plan view of the cylinder head 3 excluding some components of the variable valve operating device 40, the cylinder head 3 is of a rectangular shape made up of a front side wall 3Fr, a rear side wall 3Rr, a left side wall 3L, and a right side wall 3R. The valve operating chamber 3*c* is partitioned by a bearing wall 3U disposed closely and parallel to the left side wall 3L, defining a gear chamber 3*g* on the left side of the bearing wall 3U.

The valve operating chamber 3*c* is positioned above the combustion chamber 30 and partitioned into left and right chambers by a bearing wall 3V.

The bearing wall 3U that defines the gear chamber 3*g* has an upper end surface on which there are defined front and rear concave bearing surfaces 3Ui and 3Ue as semi-arcuate surfaces. The bearing wall 3V that partitions the inside of the valve operating chamber 3*c* has an upper end surface on which there are defined front and rear concave bearing surfaces 3Vi and 3Ve as semi-arcuate surfaces. The bearing wall 3V has a plug insertion tube 3Vp disposed centrally therein for the spark ignition plug 23 inserted therein.

Figure 4:
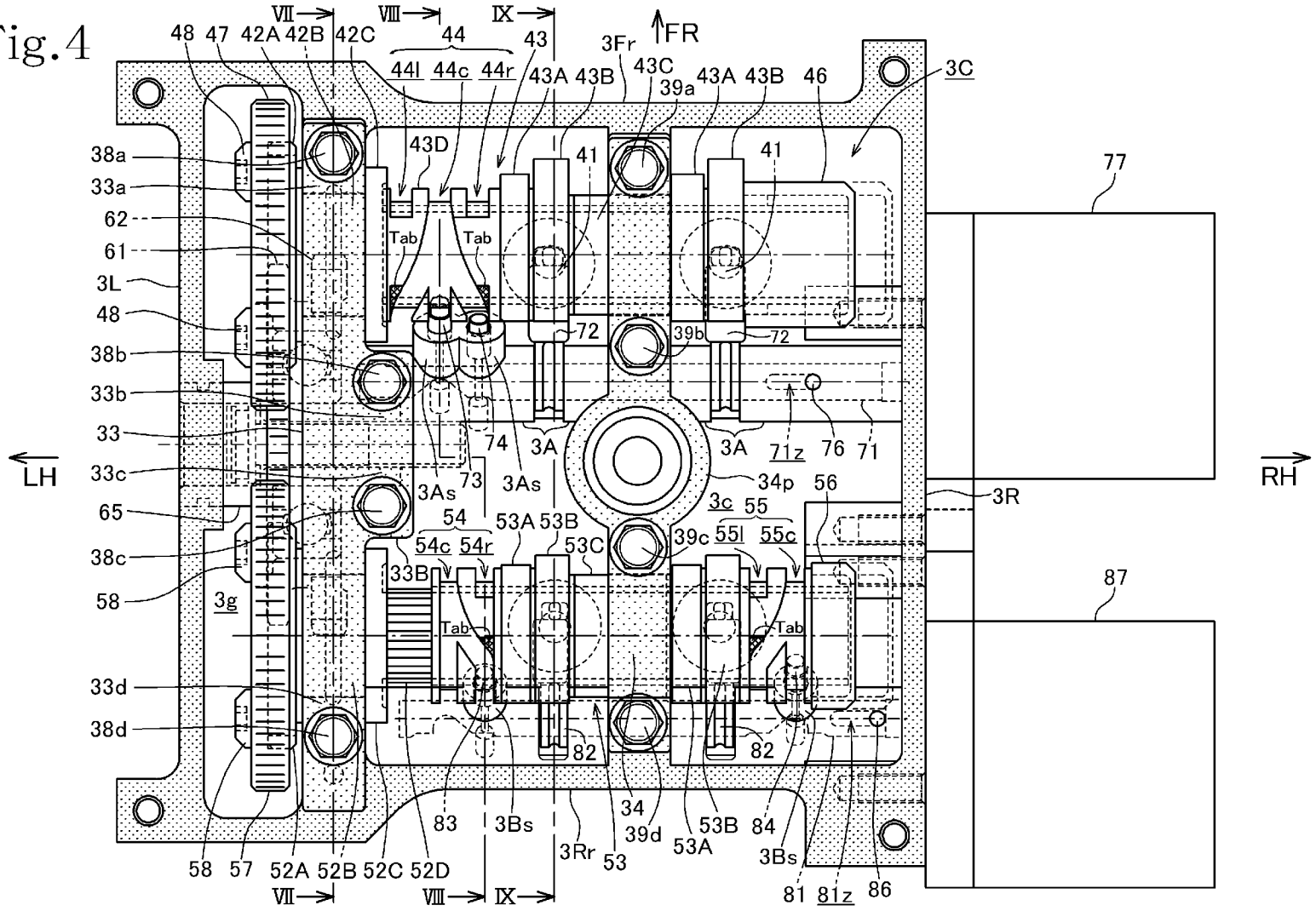
FIG. 4 is a plan view of a cylinder head with a cylinder head cover removed.

An intake camshaft 42 (FIG. 7) is disposed above the intake valves 41 provided as a pair of left and right intake valves, and extends in the leftward and rightward directions. An exhaust camshaft 52 (FIG. 7) is disposed above the exhaust valves 51, which are provided as a pair of left and right exhaust valves, and extends in the leftward and rightward directions. The intake camshaft 42 and the exhaust camshaft 52 are rotatably supported between the bearing walls 3U and 3V that lie perpendicularly to the axial directions (the leftward and rightward directions) of the cylinder head 3 and camshaft holders 33 and 34 (FIGS. 4 and 10).

Figure 5:
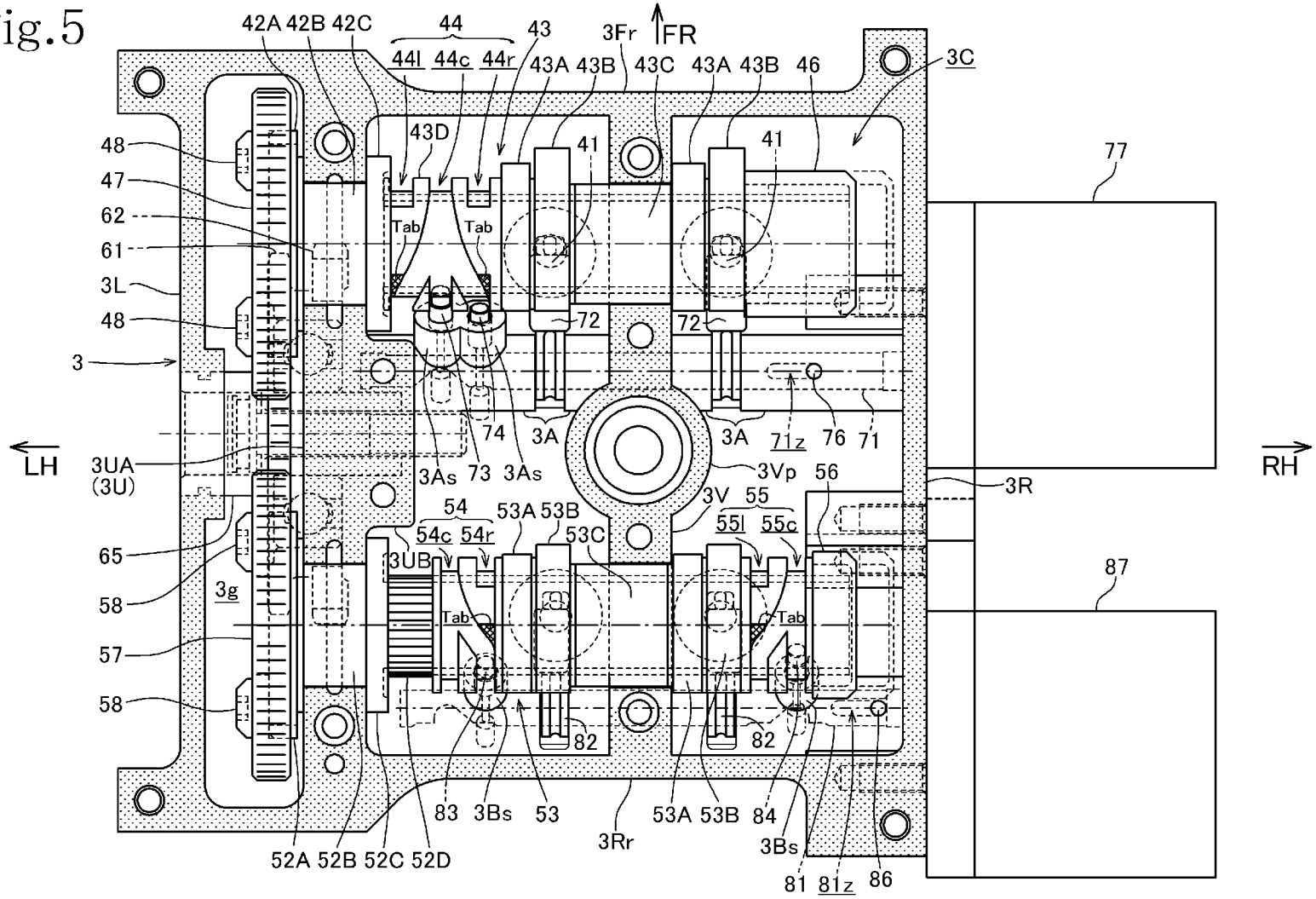
FIG. 5 is a plan view of the cylinder head with camshaft holders further removed.
Figure 10:
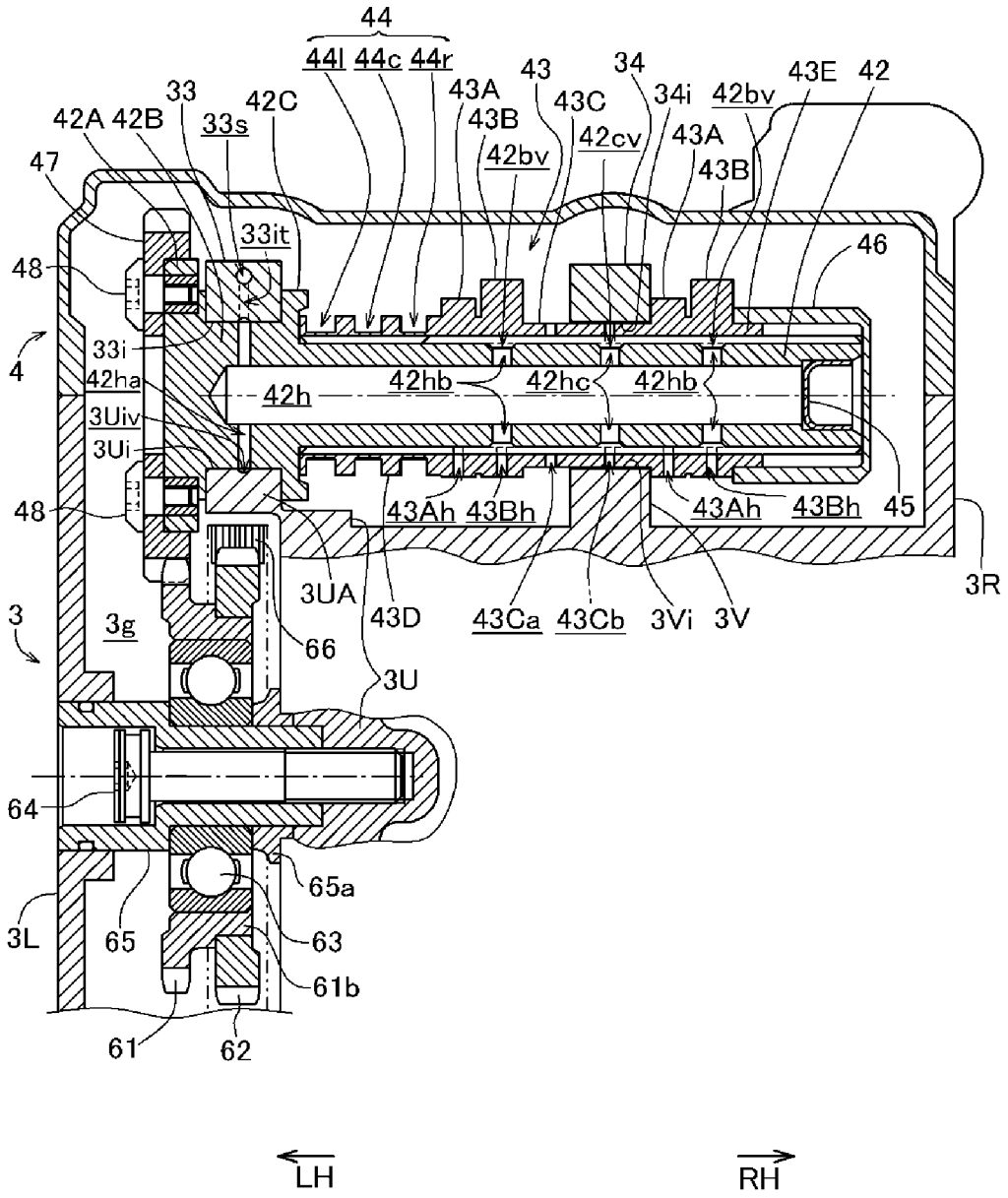
FIG. 10 is a cross-sectional view taken along line X-X of FIG. 2.
Figure 11:
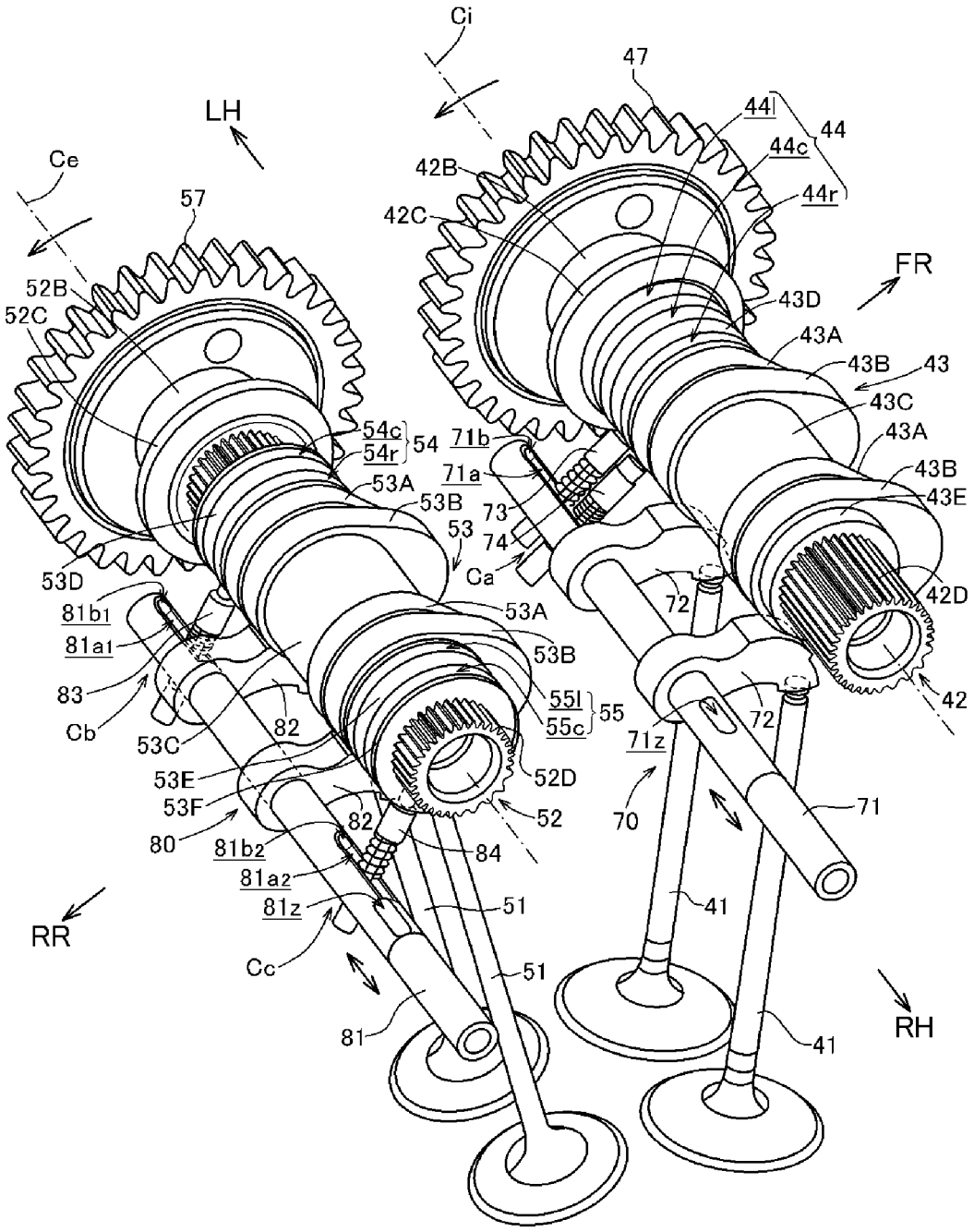
FIG. 11 is a perspective view of major components of an intake cam switching mechanism and an exhaust cam switching mechanism.

Referring to FIGS. 5, 10, and 11, the intake camshaft 42 has a journal 42B having an increased diameter on a left end portion thereof and flanges 42A and 42C on the left and right ends of the journal 42B.

The intake camshaft 42 includes a splined shaft portion 42D extending rightwardly from the right flange 42C and having external spline teeth on its outer circumferential surface.

The intake camshaft 42 has an oil supply passage 42*h* defined therein that extends along its central axis from the right end face through the splined shaft portion 42D into the journal 42B. Oil supply fluid communication holes 42*ha* extend from the left end of the oil supply passage 42*h* radially outwardly through the journal 42B to an outer circumferential surface of the journal 42B. The splined shaft portion 42D has a left cam fluid communication oil hole 42*hb*, a bearing fluid communication oil hole 42*hc*, and a right cam fluid communication oil hole 42*hb* defined therein that extend radially outwardly from the oil supply passage 42*h* at three axially spaced locations.

The left cam fluid communication oil hole 42*hb*, the bearing fluid communication oil hole 42*hc*, and the right cam fluid communication oil hole 42*hb* are open respectively into three grooves including a cam outer circumferential groove 42*bv*, a bearing outer circumferential groove 42*cv*, and a cam outer circumferential groove 42*bv* that are defined in and extend around an outer circumferential surface of the splined shaft portion 42D (see FIG. 10).

The oil supply passage 42*h* has a right end closed by a plug 45 pressure-fitted therein.

The cylinder head 3 has a bearing portion 3UA that has the concave bearing surfaces 3Ui and 3Ue on which the intake camshaft 42 and the exhaust camshaft 52 are supported. The concave bearing surfaces 3Ui and 3Ue have respective inner circumferential oil grooves 3Uiv and 3Uev as illustrated in FIGS. 6 and 7.

Figure 7:
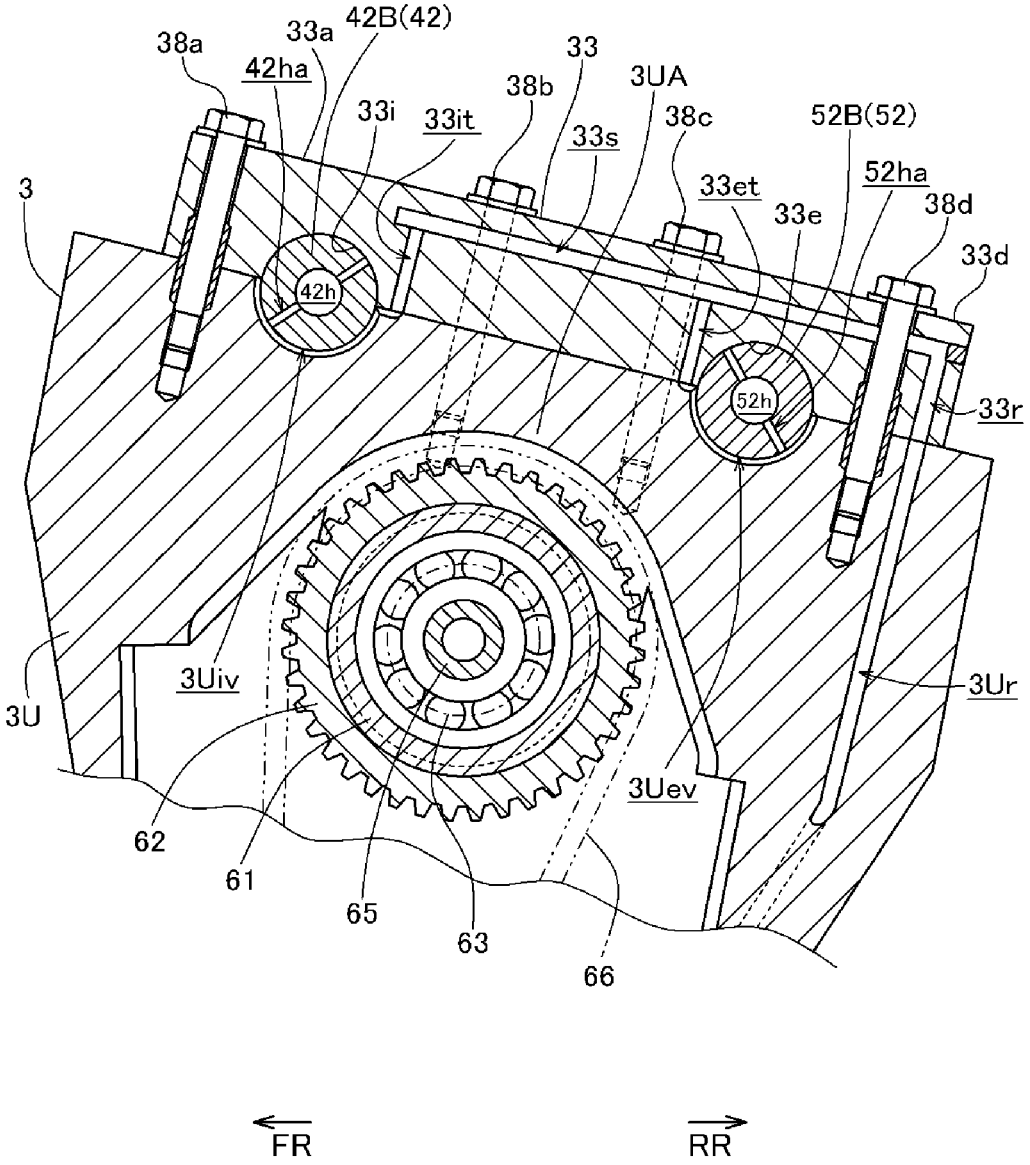
FIG. 7 is a cross-sectional view taken along line VII-VII of FIG. 4.

Referring to FIG. 7, the camshaft holder 33 has a common oil passage 33*s* defined therein that extends in the forward and rearward directions along an upper surface of the camshaft holder 33. The common oil passage 33*s* extends in common above concave bearing surfaces 33*i* and 33*e* of the camshaft holder 33 on which the intake camshaft 42 and the exhaust camshaft 52 are supported.

The common oil passage 33*s* extends across a bolt hole for a fastening bolt 38*d* to be described later.

The common oil passage 33*s* is branched into branch oil passages 33*it* and 33*et* defined in the camshaft holder 33 and extending toward a mating surface thereof that is mated to the bearing portion 3UA of the cylinder head 3 (see FIG. 7).

As illustrated in FIG. 7, the branch oil passage 33*it* is held in fluid communication with the inner circumferential oil groove 3Uiv that is open at a rear portion of the concave bearing surface 3Ui of the cylinder head 3, and the branch oil passage 33*et* is held in fluid communication with the inner circumferential oil groove 3Uev that is open at a front portion of the concave bearing surface 3Ue of the cylinder head 3.

The common oil passage 33*s* has a rear end held in fluid communication with a vertical oil passage 33*r* defined in the camshaft holder 33. The vertical oil passage 33*r* is held in fluid communication with a vertical oil passage 3Ur defined in the bearing wall 3U of the cylinder head 3.

Consequently, oil that has passed through the vertical oil passage 3Ur in the cylinder head 3 flows through the vertical oil passage 33*r* in the camshaft holder 33 into the common oil passage 33*s*, from which the oil is distributed into the branch oil passages 33*it* and 33*et* and supplied therefrom to the front and rear inner circumferential oil grooves 3Uiv and 3Uev, lubricating the bearings for the intake camshaft 42 and the exhaust camshaft 52.

As illustrated in FIGS. 7 and 10, the oil supply fluid communication hole 42*ha* that is defined in the journal 42B of the intake camshaft 42 is open into the inner circumferential oil groove 3Uiv. Oil flows from the inner circumferential oil groove 3Uiv through the oil supply fluid communication hole 42*ha* and is supplied to the oil supply passage 42*h* in the intake camshaft 42.

Similarly, an oil supply fluid communication hole 52*ha* that is defined in a journal 52B of the exhaust camshaft 52 is open into the inner circumferential oil groove 3Uev. Oil flows from the inner circumferential oil groove 3Uev through the oil supply fluid communication hole 52*ha* and is supplied to an oil supply passage 52*h* in the exhaust camshaft 52.

Referring to FIG. 10, the oil supplied from the oil supply fluid communication hole 42*ha* in the journal 42B of the intake camshaft 42 to the oil supply passage 42*h* is discharged from the cam fluid communication oil hole 42*hb*, the bearing fluid communication oil hole 42*hc*, and the cam fluid communication oil hole 42*hb* to the outer circumferential surface of the splined shaft portion 42D.

The oil supplied from the oil supply fluid communication hole 52*ha* in the journal 52B of the exhaust camshaft 52 to the oil supply passage 52*h* is discharged from similar fluid communication oil holes not illustrated to the outer circumferential surface of a splined shaft portion 52D.

An intake cam carrier 43 in the form of a tubular member is splined to the splined shaft portion 42D of the intake camshaft 42.

The intake cam carrier 43 is axially slidably, but relatively nonrotatably, fitted over the intake camshaft 42.

The splined region is supplied with the oil discharged from the cam fluid communication oil hole 42*hb*, the bearing fluid communication oil hole 42*hc*, and the cam fluid communication oil hole 42*hb* (see FIG. 10).

The intake cam carrier 43 has on its outer circumferential surface left and right sets of a low-speed cam lobe 43A having a lower cam profile and a smaller valve lift and a high-speed cam lobe 43B having a higher cam profile and a larger valve lift, the low-speed cam lobe 43A and the high-speed cam lobe 43B being disposed in left and right positions axially adjacent to each other. The left and right sets of the cam lobes 43A and 43B are disposed one on each side of a tubular journal 43C that has a predetermined axial width.

Figure 8:
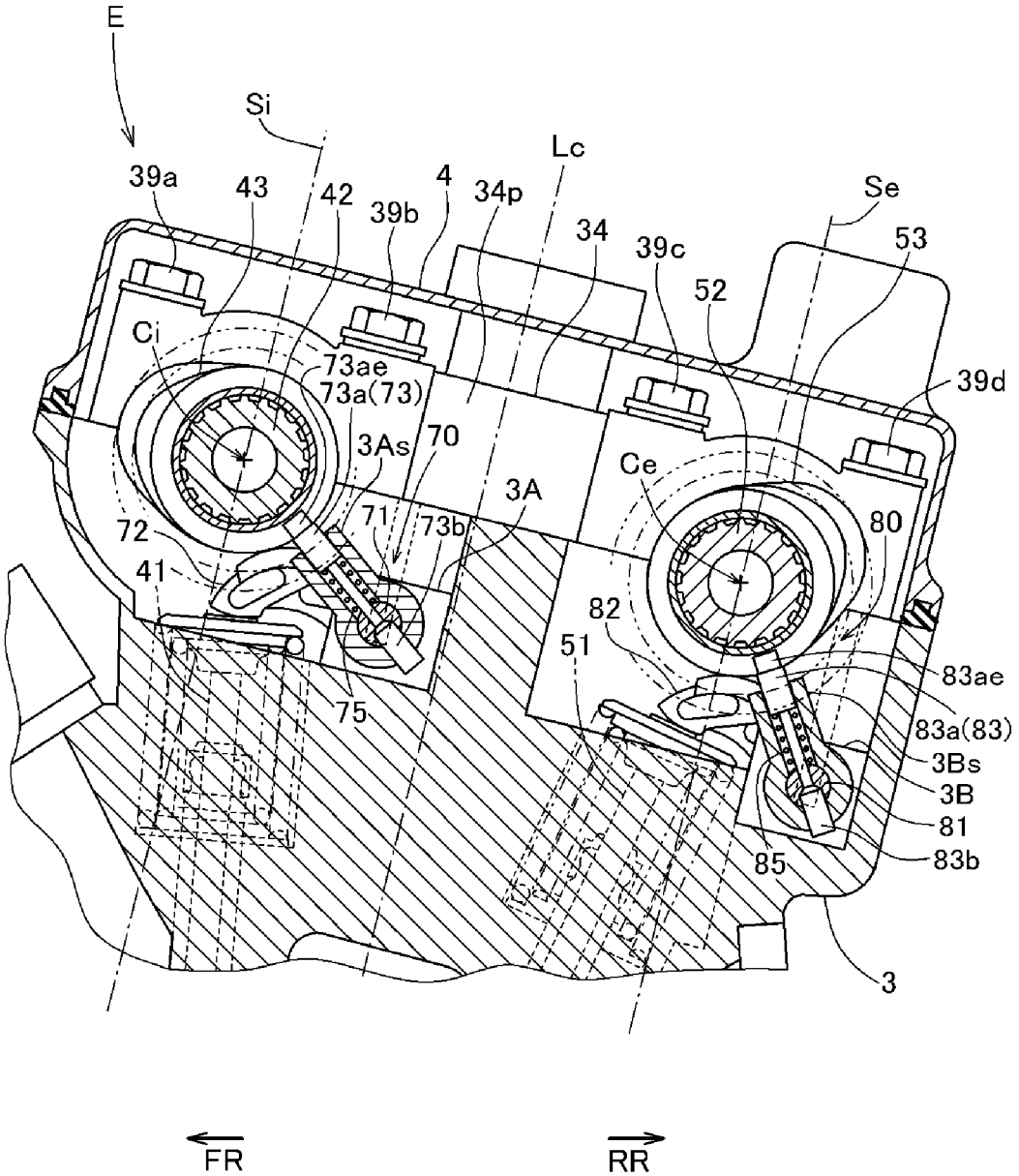
FIG. 8 is a cross-sectional view taken along line VIII-VIII of FIG. 4 with the cylinder head cover added.

As can be seen from FIGS. 8 and 11, the low-speed cam lobe 43A and the high-speed cam lobe 43B that are disposed adjacent to each other in each set have respective cam profiles including base circles whose outside diameters are equal to each other, and are disposed in the same circumferential positions.

Referring to FIGS. 5 and 10, the intake cam carrier 43 has a lead groove tubular portion 43D with a lead groove 44 defined circumferentially therein, disposed leftwardly of the left low-speed cam lobe 43A of the left set of the low-speed cam lobe 43A and the high-speed cam lobe 43B, and a right end tubular portion 43E disposed rightwardly of the right high-speed cam lobe 43B of the right set of the low-speed cam lobe 43A and the high-speed cam lobe 43B.

The outside diameter of the lead groove tubular portion 43D is smaller than the equal outside diameters of the base circles of the low-speed cam lobe 43A and the high-speed cam lobe 43B (see FIG. 10).

The lead groove 44 in the lead groove tubular portion 43D includes an annular steady lead groove 44*c* disposed in a fixed axial position and extending annularly fully circumferentially, and a left shift lead groove 441 and a right shift lead groove 44*r* that are branched respectively leftwardly and rightwardly from the steady lead groove 44*c* and extend spirally to respective positions that are axially spaced leftwardly and rightwardly by predetermined distances (see FIGS. 4 and 10).

Referring to FIG. 10, the tubular journal 43C of the intake cam carrier 43 has bearing oil supply holes 43Ca and 43Cb defined therein respectively at axially spaced two positions and providing fluid communication between the inside and outside of the tubular journal 43C.

Figure 9:
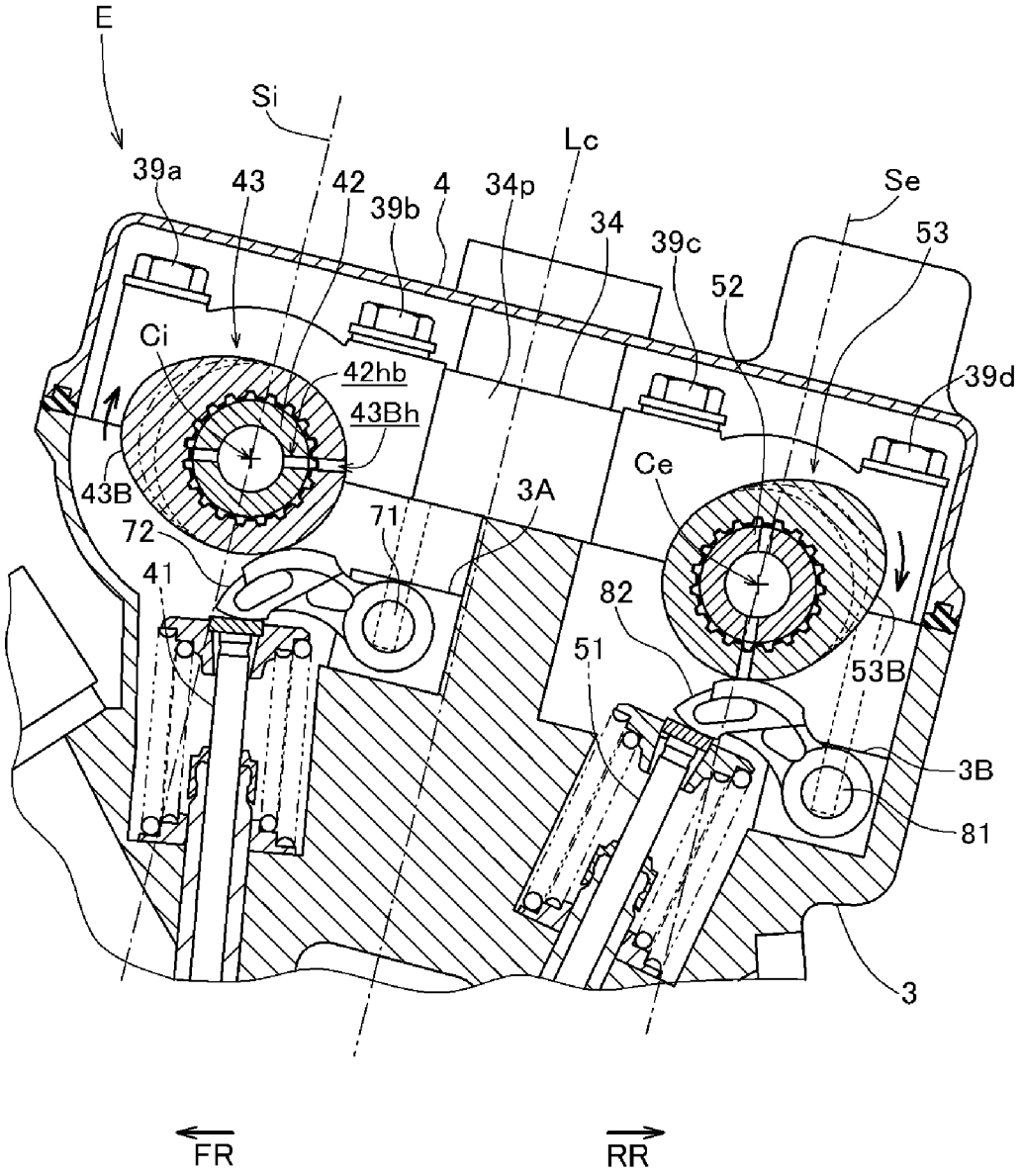
FIG. 9 is a cross-sectional view taken along line IX-IX of FIG. 4 with the cylinder head cover added.

The low-speed cam lobes 43A and the high-speed cam lobs 43B also have respective cam oil supply holes 43Ah and 43Bh defined therein that provide fluid communication from the inside thereof to the outside of the cam surfaces of their base circles (see FIGS. 9 and 10).

The intake cam carrier 43 and an exhaust cam carrier 53 rotate clockwise about their own axes as viewed in side elevation in FIG. 9. The cam surface of the high-speed cam lobe 43B, illustrated in FIG. 9, of the intake cam carrier 43 as it rotates is held in sliding contact with an intake rocker arm 72, to be described later, swinging the intake rocker arm 72 to operate the intake valve 41.

The cam surface provided by the cam profile of the high-speed cam lobe 43B includes a side where the cam surface pressure increases by slidingly contacting the intake rocker arm 72 earlier and a side where the cam surface pressure decreases by slidingly contacting the intake rocker arm 72 later. The cam oil supply hole 43Bh in the high-speed cam lobe 43B is defined so as to be open at a position closer to the side where the cam surface pressure increases than the side where the cam surface pressure decreases, on the cam profile of the cam surface of the base circle of the high-speed cam lobe 43B.

Similarly, the cam oil supply hole 43Ah in the low-speed cam lobe 43A is defined so as to be open at a position closer to the side where the cam surface pressure increases than the side where the cam surface pressure decreases, on the cam profile of the cam surface of the base circle of the low-speed cam lobe 43A.

Cam oil supply holes defined in low-speed cam lobes 53A and high-speed cam lobes 53B of the exhaust cam carrier 53 are similarly positioned.

Referring to FIG. 10, a cap 46 in the form of a bottomed tube is fitted over the right end tubular portion 43E of the intake cam carrier 43.

An intake driven gear 47 is coaxially fitted over and integrally fastened to a left side of the left flange 42A of the intake camshaft 42 by two screws 48.

As illustrated in FIG. 10, with the intake cam carrier 43 splined to the splined shaft portion 42D of the intake camshaft 42 and with the cap 46 placed over the right end tubular portion 43E of the intake cam carrier 43, the journal 42B of the intake camshaft 42 is sandwiched and rotatably supported by the concave bearing surface 3Ui of the bearing wall 3U of the cylinder head 3 and the concave bearing surface 33*i*, defined as a semi-arcuate surface, of the camshaft holder 33, and the tubular journal 43C of the intake cam carrier 43 is sandwiched and rotatably supported by the concave bearing surface 3Vi of the bearing wall 3V of the cylinder head 3 and a concave bearing surface 34*i*, defined as a semi-arcuate surface, of the camshaft holder 34.

The intake camshaft 42 is axially positioned by the left and right flanges 42A and 42C of the journal 42B that sandwich therebetween the bearing wall 3U of the cylinder head 3 and the camshaft holder 33. The intake driven gear 47 fastened to the left flange 42A is positioned in the gear chamber 3*g*.

The intake cam carrier 43 that is splined to the splined shaft portion 42D of the intake camshaft 42 that is thus axially positioned is axially movable while rotating together with the intake camshaft 42.

Since the tubular journal 43C, which has a predetermined axial width, of the intake cam carrier 43 is borne by the bearing wall 3V of the cylinder head 3 and the camshaft holder 34, the intake cam carrier 43 is limited in axial movement when the high-speed cam lobe 43B on the left side of the bearing wall 3V and the camshaft holder 34 and the low-speed cam lobe 43A on the right side of the bearing wall 3V and the camshaft holder 34 abut against the bearing wall 3V and the camshaft holder 34 (see FIG. 10).

Referring to FIG. 10, oil in the oil supply passage 42*h* in the intake camshaft 42 flows out of the cam fluid communication oil hole 42*hb*, the bearing fluid communication oil hole 42*hc*, and the cam fluid communication oil hole 42*hb* respectively into the cam outer circumferential groove 42*bv*, the bearing outer circumferential groove 42*cv*, and the cam outer circumferential groove 42*bv*, lubricating the splined region between the outer circumferential surface of the splined shaft portion 42D and the intake cam carrier 43. The bearing fluid communication oil hole 42*hc* in the journal 42B of the intake camshaft 42 is in the same axial position as the bearing wall 3V and the camshaft holder 34, and the bearing-borne tubular journal 43C of the intake cam carrier 43 that is axially movable over the bearing fluid communication oil hole 42*hc* has the two bearing oil supply holes 43Ca and 43Cb defined therein. When the intake cam carrier 43 is shifted to the left, as illustrated in FIG. 5, one of the bearing oil supply holes 43Cb faces the bearing fluid communication oil hole 42*hc*, and when the intake cam carrier 43 is shifted to the right, the other of the bearing oil supply holes 43Ca faces the bearing fluid communication oil hole 42*hc*. Therefore, when the intake cam carrier 43 is shifted to either the left or the right, oil is supplied through the bearing oil supply hole 43Ca or the bearing oil supply hole 43Cb to the concave bearing surfaces 3Vi and 34*i* to lubricate them.

The cam fluid communication oil holes 42*hb* on both sides of the bearing fluid communication oil hole 42*hc* in the intake camshaft 42 are in the same axial positions as the intake valves 41 (and the intake rocker arms 72 to be described later). When the intake cam carrier 43 is shifted to the left, the high-speed cam lobes 43B are in the same axial positions as the cam fluid communication oil holes 42*hb* (see FIG. 5), and when the intake cam carrier 43 is shifted to the right, the low-speed cam lobes 43A are in the same axial positions as the cam fluid communication oil holes 42*hb*.

Therefore, when the intake cam carrier 43 is shifted to the left, as illustrated in FIG. 10, the cam oil supply holes 43Bh in the high-speed cam lobes 43B face the cam fluid communication oil holes 42*hb* in the intake camshaft 42, supplying oil to the cam surfaces of the high-speed cam lobes 43B to lubricate their surfaces that are held in sliding contact with the intake rocker arms 72.

When the intake cam carrier 43 is shifted to the right, the cam oil supply holes 43Ah in the low-speed cam lobes 43A face the cam fluid communication oil holes 42*hb* in the intake camshaft 42, supplying oil to the cam surfaces of the low-speed cam lobes 43A to lubricate their surfaces that are held in sliding contact with the intake rocker arms 72.

Consequently, when the intake cam carrier 43 is shifted to either the left or the right, oil is supplied to the surfaces of the cam lobes 43A and 43B and the intake rocker arms 72 that are held in sliding contact with each other to lubricate them.

As illustrated in FIG. 5, the exhaust camshaft 52 is shaped like the intake camshaft 42, and includes a left flange 52A, the journal 52B, a right flange 52C, and the splined shaft portion 52D that are successively arranged.

As with the intake cam carrier 43, the exhaust cam carrier 53 that is splined to the splined shaft portion 52D of the exhaust camshaft 52 has on its outer circumferential surface left and right sets of a low-speed cam lobe 53A having a lower cam profile and a smaller valve lift and a high-speed cam lobe 53B having a higher cam profile and a larger valve lift, the low-speed cam lobe 53A and the high-speed cam lobe 53B being disposed in left and right positions axially adjacent to each other. The left and right sets of the cam lobes 53A and 53B are disposed one on each side of a bearing-borne tubular journal 53C that has a predetermined axial width.

The low-speed cam lobe 53A and the high-speed cam lobe 53B that are disposed adjacent to each other in each set have respective cam profiles including base circles whose outside diameters are equal to each other.

Referring to FIG. 11, unlike the intake cam carrier 43, the exhaust cam carrier 53 includes two separate lead grooves. The exhaust cam carrier 53 has a lead groove tubular portion 53D with a left lead groove 54 defined circumferentially therein, disposed leftwardly of the low-speed cam lobe 53A of the left set, a lead groove tubular portion 53E with a left lead groove 55 defined circumferentially therein, disposed rightwardly of the high-speed cam lobe 53B of the right set, and a right end tubular portion 53F disposed rightwardly of the lead groove tubular portion 53E.

The outside diameters of the lead groove tubular portions 53D and 53E are smaller than the equal outside diameters of the base circles of the low-speed cam lobe 53A and the high-speed cam lobe 53B.

Referring to FIGS. 4 and 5, the lead groove 54 in the left lead groove tubular portion 53D includes an annular steady lead groove 54*c* disposed in a fixed axial position close to a left end face of the exhaust cam carrier 53 and extending fully circumferentially, and a right shift lead groove 54*r* that is branched rightwardly from the steady lead groove 54*c* and extends spirally to a position that is axially spaced rightwardly by a predetermined distance.

The lead groove 55 in the right lead groove tubular portion 53E includes an annular steady lead groove 55*c* disposed in a fixed axial position and extending fully circumferentially, and a left shift lead groove 551 that is branched leftwardly from the steady lead groove 55*c* and extends spirally to a position that is axially spaced leftwardly by a predetermined distance.

A cap 56 in the form of a bottomed tube is fitted over the right end tubular portion 53F (see FIG. 11) of the exhaust cam carrier 53, as illustrated in FIG. 5.

An exhaust driven gear 57 is coaxially fitted over and integrally fastened to a left side of the left flange 52A of the exhaust camshaft 52 by two screws 58 (see FIGS. 4 and 5).

As illustrated in FIG. 5, with the exhaust cam carrier 53 splined to the splined shaft portion 52D of the exhaust camshaft 52 and with the cap 56 placed over the right end tubular portion 53F of the exhaust cam carrier 53, the journal 52B of the exhaust camshaft 52 is sandwiched and rotatably supported by the concave bearing surface 3Ue of the bearing wall 3U of the cylinder head 3 illustrated in FIG. 6 and the concave bearing surface, defined as a semi-arcuate surface, of the camshaft holder 33, and the tubular journal 53C of the exhaust cam carrier 53 is sandwiched and rotatably supported by the concave bearing surface 3Ve of the bearing wall 3V of the cylinder head 3 and a concave bearing surface, defined as a semi-arcuate surface, of the camshaft holder 34 (the state illustrated in FIG. 4).

The exhaust camshaft 52 is axially positioned by the left and right flanges 52A and 52C of the journal 52B that sandwich therebetween the bearing wall 3U of the cylinder head 3 and the camshaft holder 33. The exhaust driven gear 57 fastened to the left flange 52A is positioned in the gear chamber 3*g*.

The exhaust cam carrier 53 that is splined to the splined shaft portion 52D of the exhaust camshaft 52 that is thus axially positioned is axially movable while rotating together with the exhaust camshaft 52.

Since the tubular journal 53C, which has a predetermined axial width, is borne by the bearing wall 3V of the cylinder head 3 and the camshaft holder 34, the exhaust cam carrier 53 is limited in axial movement when the high-speed cam lobe 53B on the left side of the bearing wall 3V and the camshaft holder 34 and the low-speed cam lobe 53A on the right side of the bearing wall 3V and the camshaft holder 34 abut against the bearing wall 3V and the camshaft holder 34.

Passages for oil for lubricating the splined region between the exhaust camshaft 52 and the exhaust cam carrier 53 and other bearings are of substantially the same structure as those for the intake camshaft 42 and the intake cam carrier 43.

The intake driven gear 47 that is attached to the left flange 42A of the intake camshaft 42 and the exhaust driven gear 57 that is attached to the left flange 52A of the exhaust camshaft 52 are arrayed in front and rear positions in the gear chamber 3*g*.

As illustrated in FIG. 2, an idle gear 61 held in mesh with the front intake driven gear 47 and the rear exhaust driven gear 57 that are of the same diameter as each other is disposed below a position therebetween.

The idle gear 61 is of a diameter larger than the intake driven gear 47 and the exhaust driven gear 57. As illustrated in FIG. 10, the idle gear 61 is rotatably supported by a bearing 63 on a tubular support shaft 65 mounted on and extending between the left side wall 3L of the cylinder head 3 and the bearing wall 3U thereof through the gear chamber 3*g*.

The tubular support shaft 65 extends through the left side wall 3L and is fixed to the bearing wall 3U by a bolt 64.

The tubular support shaft 65 has a larger-diameter end face that grips the inner race of the bearing 63 between itself and the bearing wall 3U with a collar 65*a* interposed therebetween. The inner race of the bearing 63 and the collar 65*a* are fixed in position by the bolt 64 that is tightened.

Referring to FIG. 10, the idle gear 61 includes a tubular boss 61*b* fitted over the outer race of the bearing 63 and projecting to the right. An idle chain sprocket 62 is fitted over the outer circumferential surface of the tubular boss 61*b*.

The idle chain sprocket 62 has a large outside diameter that is essentially the same as the idle gear 61.

As illustrated in FIGS. 7 and 10, the large-diameter idle chain sprocket 62 is in the same axial (leftward and rightward) position as the bearing portion 3UA that defines the concave bearing surfaces 3Ui and 3Ue of the upper end of the bearing wall 3U that support the journal 42B of the intake camshaft 42 and the journal 52B of the exhaust camshaft 52, and is positioned below the bearing portion 3UA.

Referring to FIG. 4, the camshaft holder 33 supports the journal 42B of the intake camshaft 42 and the journal 52B of the exhaust camshaft 52 by sandwiching them between the concave bearing surfaces 33*i* and 33*e* thereof and the concave bearing surfaces 3Ui and 3Ue of the cylinder head 3. The camshaft holder 33 has fastening regions 33*a* and 33*b* with bolt holes defined therein, disposed on front and rear sides of the intake camshaft 42 and fastened to the cylinder head 3 by fastening bolts 38*a* and 38*b*, and also has fastening regions 33*c* and 33*d* with bolt holes defined therein, disposed on front and rear sides of the exhaust camshaft 52 and fastened to the cylinder head 3 by fastening bolts 38*c* and 38*d*.

As the large-diameter idle chain sprocket 62 is disposed below the bearing portion 3UA of the cylinder head 3, as illustrated in FIGS. 4 and 7, the front and rear outer fastening bolts 38*a* and 38*d* of the four fastening bolts 38*a*, 38*b*, 38*c*, and 38*d* fasten the fastening regions 33*a* and 33*d* on both sides of the idle chain sprocket 62.

As illustrated in FIGS. 4 and 5, the bearing wall 3U of the cylinder head 3 and the camshaft holder 33 have respective protrusive portions 3UB and 33B that protrude axially inwardly (rightwardly) between the intake camshaft 42 and the exhaust camshaft 52.

The protrusive portions 3UB and 33B protrude to a position clear axially inwardly (rightwardly) of the idle chain sprocket 62 disposed therebelow. As illustrated in FIGS. 4 and 5, the protrusive portions 3UB and 33B are in the same axial position as the lead groove tubular portion 43D of the intake cam carrier 43 and are disposed closely to each other forwardly and rearwardly.

The two inner fastening bolts 38*b* and 38*c* of the four fastening bolts 38*a*, 38*b*, 38*c*, and 38*d* fasten the fastening regions 33*b* and 33*c* on the protrusive portion 33B (see FIGS. 4 and 7).

Referring to FIG. 4, the camshaft holder 34 that sandwiches and supports the tubular journal 43C of the intake cam carrier 43 and the tubular journal 53C of the exhaust cam carrier 53 between itself and the bearing wall 3V has front and rear sides with the tubular journal 43C interposed therebetween, fastened by fastening bolts 39*a* and 39*b*, and front and rear sides with the tubular journal 53C interposed therebetween, fastened by fastening bolts 39*c* and 39*d*.

The camshaft holder 34 has a spark ignition plug insertion tube 34*p* disposed centrally therein that is coupled to the spark ignition plug insertion tube 3Vp in the bearing wall 3V (see FIG. 4).

Referring to FIG. 2, a cam chain 66 is trained around the large-diameter idle chain sprocket 62 and also around a small-diameter drive chain sprocket 67 fitted over the lower crankshaft 10.

The cam chain 66 that is trained around the idle chain sprocket 62 and the drive chain sprocket 67 is tensioned by a cam chain tensioner guide 68 and circulates while being guided by a cam chain guide 69.

Rotation of the crankshaft 10 is transmitted through the cam chain 66 to the idle chain sprocket 62, rotating the idle chain sprocket 62 together with the idle gear 61. Rotation of the idle gear 61 rotates the intake driven gear 47 and the exhaust driven gear 57 that are held in mesh with the idle gear 61. The intake driven gear 47 rotates in unison with the intake camshaft 42, and the exhaust driven gear 57 rotates in unison with the exhaust camshaft 52.

FIG. 11 is a perspective view illustrating only major components of an intake cam switching mechanism 70 and an exhaust cam switching mechanism 80 of the variable valve operating device 40.

The intake cam carrier 43 and the exhaust cam carrier 53 are splined respectively to the intake camshaft 42 and the exhaust camshaft 52 that rotate in synchronism with the crankshaft 10.

An intake switching drive shaft 71 of the intake cam switching mechanism 70 is disposed obliquely rearwardly and downwardly of the intake camshaft 42 and extends parallel to the intake camshaft 42. An exhaust switching drive shaft 81 of the exhaust cam switching mechanism 80 is disposed obliquely rearwardly and downwardly of the exhaust camshaft 52 and extends parallel to the exhaust camshaft 52.

The intake switching drive shaft 71 and the exhaust switching drive shaft 81 are supported on the cylinder head 3.

Referring to FIG. 6, a tubular member 3A oriented in the leftward and rightward directions in the valve operating chamber 3*c* in the cylinder head 3 is disposed in a position spaced slightly forwardly from the center in the valve operating chamber 3*c* and extends linearly from the bearing wall 3U through the bearing wall 3V to the right side wall 3R.

A tubular member 3B oriented in the leftward and rightward directions in the valve operating chamber 3*c* in the cylinder head 3 is disposed on an inner surface of the rear side wall 3Rr and extends linearly from the bearing wall 3U through the bearing wall 3V to the right side wall 3R.

The tubular member 3A has an axial hole defined therein with the intake switching drive shaft 71 axially slidably fitted and inserted therein, and the tubular member 3B has an axial hole defined therein with the exhaust switching drive shaft 81 axially slidably fitted and inserted therein.

The tubular member 3A is devoid of its wall at two respective regions corresponding to the left and right intake valves 41 at positions on both sides of the bearing wall 3V, exposing portions of the intake switching drive shaft 71. The intake rocker arms 72 are swingably supported on the exposed portions of the intake switching drive shaft 71 (see FIG. 8).

Therefore, the intake switching drive shaft 71 doubles as a rocker arm shaft.

Referring to FIG. 11, the intake rocker arms 72 have respective distal end portions abutting against the upper end faces of the intake valves 41. Upon movement of the intake cam carrier 43, either the low-speed cam lobes 43A or the high-speed cam lobes 43B are brought into sliding contact with curved upper end faces of the intake rocker arms 72.

Therefore, when the intake cam carrier 43 rotates about its own axis, either the low-speed cam lobes 43A or the high-speed cam lobes 43B swing the intake rocker arms 72 according to their cam profile, pressing the intake valves 41 to open intake valve openings into the combustion chamber 30.

Similarly, the tubular member 3B is devoid of its wall at two respective regions corresponding to the left and right exhaust valves 51 at positions on both sides of the bearing wall 3V, exposing portions of the exhaust switching drive shaft 81. The exhaust rocker arms 82 are swingably supported on the exposed portions of the exhaust switching drive shaft 81 (see FIG. 6).

Therefore, the exhaust switching drive shaft 81 doubles as a rocker arm shaft.

Referring to FIG. 11, the exhaust rocker arms 82 have respective distal end portions abutting against the upper end faces of the exhaust valves 51. Upon movement of the exhaust cam carrier 53, either the low-speed cam lobes 53A or the high-speed cam lobes 53B are brought into sliding contact with curved upper end faces of the exhaust rocker arms 82.

Therefore, when the exhaust cam carrier 53 rotates about its own axis, either the low-speed cam lobes 53A or the high-speed cam lobes 53B swing the exhaust rocker arms 82 according to their cam profile, pressing the exhaust valves 51 to open exhaust valve openings into the combustion chamber 30.

Referring to FIGS. 5 and 6, two left and right adjacent tubular bosses 3As project from the tubular member 3A toward the lead groove tubular portion 43D of the intake cam carrier 43 at positions near the bearing wall 3U that correspond to the lead groove tubular portion 43D.

The tubular bosses 3As have respective inner holes defined therein that extend through the tubular member 3A.

A first switching pin 73 and a second switching pin 74 are slidably fitted and inserted individually in the inner holes in the left and right tubular bosses 3As.

Referring to FIG. 8, the tubular bosses 3As have distal-end openings from which the first switching pin 73 and the second switching pin 74 project. The distal-end openings overlap a maximum-diameter circle of the cam profiles of the low-speed cam lobe 43A and the high-speed cam lobe 43B, as viewed along the axial directions in FIG. 8.

Specifically, the maximum-diameter circle of the low-speed cam lobe 43A that has the smaller cam profile overlaps the distal-end opening of the tubular boss 3As.

Therefore, the intake switching drive shaft 71 can be disposed as closely to the intake camshaft 42 as possible, making it possible to reduce the size of the internal combustion engine E.

Figure 12:
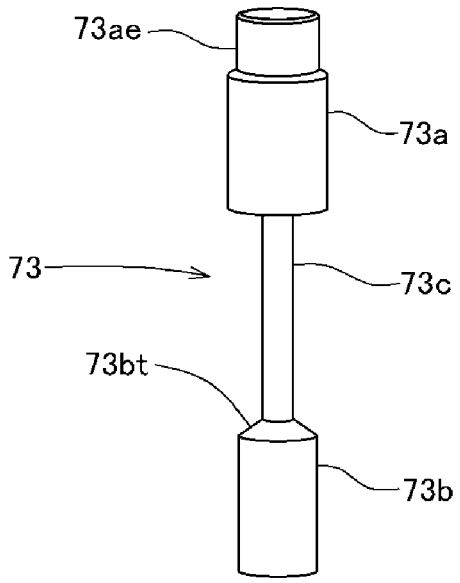
FIG. 12 is a perspective view of a switching pin.

Referring to FIG. 12, the first switching pin 73 includes a distal-end cylinder 73*a*, a proximal-end cylinder 73*b*, and an intermediate joint rod 73*c* interconnecting the distal-end cylinder 73*a* and the proximal-end cylinder 73*b* in line with each other. The proximal-end cylinder 73*b* is smaller in outside diameter than the distal-end cylinder 73*a*.

An engaging end 73*ae* having a reduced diameter projects from the distal-end cylinder 73*a*. The proximal-end cylinder 73*b* has a conical end face 73*bt* on its end joined to the intermediate joint rod 73*c*.

The proximal-end cylinder 73*b* may have a spherical end face joined to the intermediate joint rod 73*c*.

The second switching pin 74 is of a shape identical to the first switching pin 73.

Figure 13:
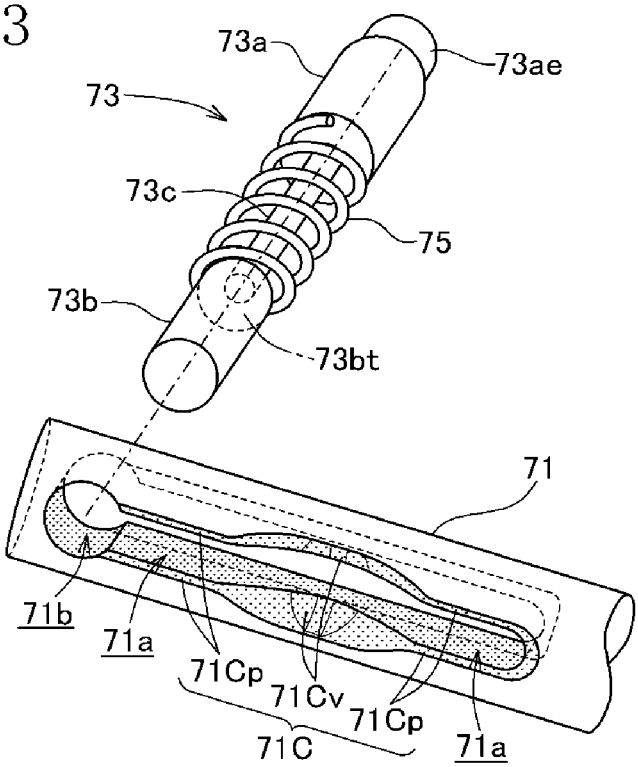
FIG. 13 is an exploded perspective view of an intake switching drive shaft and a first switching pin.

As illustrated in FIG. 13, the intake switching drive shaft 71 has an axially oblong hole 71*a* defined in a left portion thereof across the axial center thereof and a circular hole 71*b* defined in a left end of the oblong hole 71*a* across the axial center thereof.

The axially oblong hole 71*a* has a width slightly larger than the diameter of the intermediate joint rod 73*c* of the first switching pin 73. The circular hole 71*b* has an inside diameter slightly larger than the outside diameter of the proximal-end cylinder 73*b*, but smaller than the outside diameter of the distal-end cylinder 73*a*.

Referring to FIG. 13, the intake cam switching drive shaft 71 also has a cam surface 71C on an open end face of the oblong hole 71*a*. The cam surface 71C includes flat faces 71Cp formed as slanted surfaces by beveling the open end face of the oblong hole 71*a* and extending straight, and concavely curved faces 71Cv of a predetermined concave shape that are disposed in predetermined positions on the flat faces 71Cp.

Figure 14:
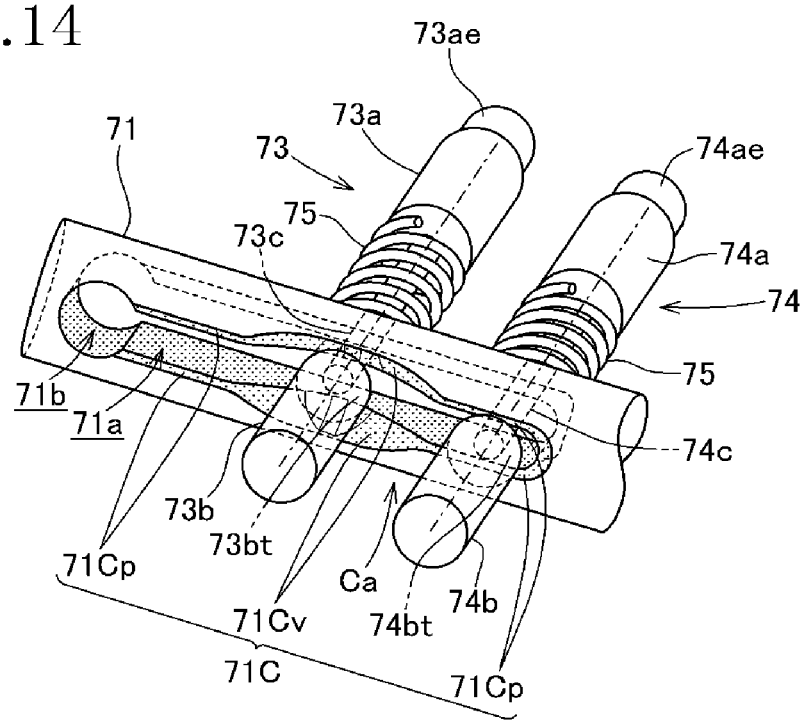
FIG. 14 is a perspective view of the intake switching drive shaft with the first switching pin and a second switching pin assembled thereon.

The intermediate joint rod 73*c* of the first switching pin 73 extends through and slidably engages in the oblong hole 71*a* in the intake cam switching drive shaft 71 (see FIG. 14).

The first switching pin 73 is assembled on the intake cam switching drive shaft 71 as follows:

As illustrated in FIG. 13, a helical spring 75 is disposed around the first switching pin 73. The helical spring 75 has an inside diameter larger than the outside diameter of the proximal-end cylinder 73*b* and an outside diameter smaller than the outside diameter of the distal-end cylinder 73*a*. Consequently, when the first switching pin 73 headed by the proximal-end cylinder 73*b* is inserted into the helical spring 75, the end face of the distal-end cylinder 73*a* that is connected to the intermediate joint rod 73*c* abuts against the end of the helical spring 75.

The intake cam switching drive shaft 71 is inserted into the axial hole in the tubular member 3A of the cylinder head 3, and the circular hole 71*b* is positioned in coaxial alignment with the inner hole in the tubular boss 3As on the tubular member 3A. When the first switching pin 73 headed by the proximal-end cylinder 73*b*, with the helical spring 75 disposed therearound, is inserted into the inner hole in the tubular boss 3As, the first switching pin 73 together with the helical spring 75 is slidably fitted and inserted in the inner hole in the tubular boss 3As (see FIG. 8) and the proximal-end cylinder 73*b* extends through the circular hole 71*b* in the intake switching drive shaft 71 inserted in the axial hole in the tubular member 3A (see FIG. 13).

Even though the proximal-end cylinder 73*b* of the first switching pin 73 extends through the circular hole 71*b* in the intake switching drive shaft 71, the helical spring 75 does not extend through the circular hole 71*b*, but has its end held against the open end face of the circular hole 71*b*, and is compressed between the open end face of the circular hole 71*b* and the end face of the distal-end cylinder 73*a*.

With the proximal-end cylinder 73*b* extending through the circular hole 71*b*, the intermediate joint rod 73*c* of the first switching pin 73 is in a position corresponding to the oblong hole 71*a* in the intake switching drive shaft 71. Therefore, when the intake switching drive shaft 71 is moved to the left, the intermediate joint rod 73*c* moves into the oblong hole 71*a* while the helical spring 75 is being compressed.

As illustrated in FIG. 14, the conical end face 73*bt* of the proximal-end cylinder 73*b* is pressed against and engages the cam surface 71C on the open end face of the oblong hole 71*a* in the intake switching drive shaft 71 under the bias of the helical spring 75, whereupon the first switching pin 73 is assembled on the intake switching drive shaft 71.

In this manner, the first switching pin 73 is assembled on the intake switching drive shaft 71 such that the intermediate joint rod 73*c* extends through the oblong hole 71*a* in the intake switching drive shaft 71 and is urged by the helical spring 75 to cause the conical end face 73*bt* of the proximal-end cylinder 73*b* to be pressed against and engage the cam surface 71C on the open end face of the oblong hole 71*a* in the intake switching drive shaft 71. Consequently, when the intake switching drive shaft 71 is moved in an axial direction thereof, the cam surface 71C slides in abutment against the conical end face 73*bt* of the proximal-end cylinder 73*b* of the first switching pin 73 that is in a constant position in the axial directions of the intake switching drive shaft 71 and is slidable, so that the first switching pin 73 is guided along the shape of the cam surface 71C to be advanced or retracted in a direction perpendicular to the axial directions of the intake switching drive shaft 71. The first switching pin 73 and the intake switching drive shaft 71 thus assembled together jointly make up a linear-motion cam mechanism Ca.

The linear-motion cam mechanism Ca operates to place the first switching pin 73 in a retracted position when the conical end face 73*bt* of the first switching pin 73 abuts against the flat faces 71Cp of the cam surface 71C of the intake switching drive shaft 71 and to advance the first switching pin 73 under the bias of the helical spring 75 when the intake switching drive shaft 71 is moved to bring the conical end face 73*bt* into abutment against the concavely curved faces 71Cv of the cam surface 71C.

The second switching pin 74 is also of a shape identical to the first switching pin 73. The second switching pin 74 is assembled on the intake switching drive shaft 71 such that the second switching pin 74 extends through the oblong hole 71*a* in the intake switching drive shaft 71 and the conical end face 74*bt* of the proximal-end cylinder 74*b* is pressed against and engages the cam surface 71C under the bias of the helical spring 75 (see FIG. 14). The second switching pin 74 also serves as part of the linear-motion cam mechanism Ca.

When the first switching pin 73 and the second switching pin 74 are to be assembled on the intake switching drive shaft 71, the second switching pin 74 is assembled earlier on the intake switching drive shaft 71.

As illustrated in FIG. 11, the intake switching drive shaft 71 includes a movement limiting hole 71*z* defined therein as an oblong hole having a predetermined length in the axial directions thereof at a position on the right side of the portion of the intake switching drive shaft 71 on which the right intake rocker arm 72 is swingably supported. A movement limiting pin 76 fitted and inserted in a small hole 3Ah defined in the tubular member 3A of the cylinder head 3 extends through the movement limiting hole 71*z* to limit axial movement of the intake switching drive shaft 71 to movement between predetermined positions (see FIG. 4).

As illustrated in FIG. 14, the first switching pin 73 and the second switching pin 74 extend through the common oblong hole 71*a* in the intake switching drive shaft 71 and are arrayed parallel to each other.

FIG. 14 illustrates the state in which the concavely curved faces 71Cv of the cam surface 71C of the intake switching drive shaft 71 has its center positioned at the first switching pin 73, the first switching pin 73 is in the advanced position with the conical end face 73*bt* abutting against the concavely curved faces 71Cv, and the second switching pin 74 is in the retracted position with the conical end face 74*bt* abutting against the flat faces 71Cp of the cam surface 71C.

When the intake switching drive shaft 71 is then moved to the right from this state, the conical end face 73*bt* of the first switching pin 73 moves from the center of the concavely curved faces 71Cv up the slanted surfaces of the concavely curved faces 71Cv and is retracted into abutment against the flat faces 71Cp, and the conical end face 74*bt* of the second switching pin 74 moves from the flat faces 71Cp down the slanted surfaces of the concavely curved faces 71Cv and is advanced into abutment against the center of the concavely curved faces 71Cv.

In this fashion, the intake switching drive shaft 71 as it moves axially causes the first switching pin 73 and the second switching pin 74 to be alternately advanced and retracted.

Referring to FIGS. 4 through 6, a tubular boss 3Bs projects from the center of the tubular member 3B on the left side of the bearing wall 3V of the cylinder head 3 toward the lead groove tubular portion 53D at a position on the left side of the exhaust rocker arm 82 that corresponds to the lead groove tubular portion 53D of the exhaust cam carrier 53, and a tubular boss 3Bs projects from the center of the tubular member 3B on the right side of the bearing wall 3V toward the lead groove tubular portion 53E at a position on the right side of the exhaust rocker arm 82 that corresponds to the lead groove tubular portion 53E.

Figure 15:
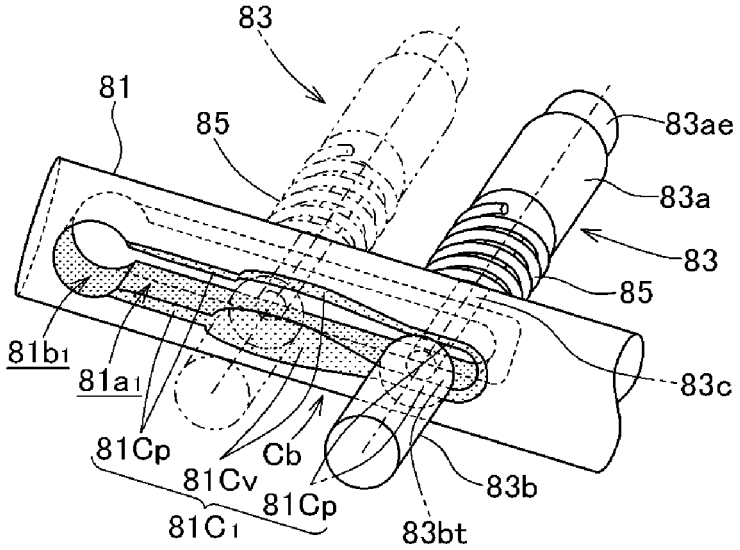
FIG. 15 is a perspective view of an exhaust switching drive shaft with a first switching pin assembled thereon.

As illustrated in FIGS. 11 and 15, the exhaust switching drive shaft 81 has oblong holes $\mathbf{81}a_1$ and $\mathbf{81}a_2$ defined in a left end portion thereof and in a right portion thereof that is spaced therefrom across the axial center thereof, and circular holes 81$b_1$ and 81$b_2$ defined in left ends of the oblong holes 81$a_1$ and 81$a_2$ across the axial center thereof.

The widths of the oblong holes 81$a_1$ and 81$a_2$ and the inside diameters of the circular holes 81$b_1$ and 81$b_2$ are the same as those of the oblong hole 71*a* and the circular hole 71*b* in the intake switching drive shaft 71.

The exhaust switching drive shaft 81 also has a cam surface 81$C_1$ on an open end face of the left oblong hole 81$a_1$. The cam surface 81$C_1$ includes flat faces 81Cp formed as slanted faces by beveling the open end face of the oblong hole 81$a_1$ and extending straight, and concavely curved faces 81Cv of a predetermined concave shape that are disposed in positions near left ends of the flat faces 81Cp.

The exhaust switching drive shaft 81 also has a cam surface 81$C_2$ on an open end face of the right oblong hole 81$a_2$. The cam surface 81$C_2$ includes flat faces 81Cp formed as slanted faces by beveling the open end face of the oblong hole 81$a_2$ and extending straight, and concavely curved faces 81Cv of a predetermined concave shape that are disposed in positions near right ends of the flat faces 81Cp.

The left and right oblong holes 81$a_1$ and 81$a_2$ and the left and right cam surfaces 81$C_1$ and 81$C_2$ of the exhaust switching drive shaft 81 are shaped in bilateral symmetry.

Referring to FIG. 15, a first switching pin 83 has an intermediate joint rod 83*c* extending through and slidably engaging in the left oblong hole 81$a_1$ in the exhaust switching drive shaft 81. The cam surface 81$C_1$ provides a linear-motion cam mechanism Cb.

Similarly, a second switching pin 84 slidably engages in the right oblong hole 81$a_2$ in the exhaust switching drive shaft 81. The cam surface 81$C_2$ provides a linear-motion cam mechanism Cc (see FIGS. 6 and 11).

The first switching pin 83 and the second switching pin 84 are assembled on the exhaust switching drive shaft 81 by using the circular holes 81$b_1$ and 81$b_2$ in the same manner as the first switching pin 73 is assembled on the intake switching drive shaft 71.

The first switching pin 83 and the second switching pin 84 are assembled simultaneously.

The exhaust switching drive shaft 81 includes a movement limiting hole 81*z* defined therein as an oblong hole having a predetermined length in the axial directions thereof at a position next to the right oblong hole 81$a_2$ on the right side thereof. A movement limiting pin 86 fitted and inserted in a small hole 3Bh defined in the tubular member 3B of the cylinder head 3 extends through the movement limiting hole 81*z* to limit axial movement of the exhaust switching drive shaft 81 to movement between predetermined positions (see FIG. 6).

FIG. 15 illustrates the state in which the right flat faces 81Cp of the left cam surface 81$C_1$ of the exhaust switching drive shaft 81 are positioned at the first switching pin 83, the first switching pin 83 is in the retracted position with the conical end face 83*bt* abutting against the flat faces 81Cp, and the second switching pin 84 is in the advanced position with the conical end face 83*bt* abutting against the concavely curved faces 81Cv of the right cam surface 81$C_2$ (see FIG. 6).

When the exhaust switching drive shaft 81 is then moved to the right from this state, the conical end face 83*bt* of the first switching pin 83 moves from the flat faces 81Cp down the slanted surfaces of the concavely curved faces 81Cv and is advanced into abutment against the center of concavely curved faces 81Cv, and the conical end face 84*bt* of the second switching pin 84 moves from the center of the concavely curved faces 81Cv up the slanted surfaces of the concavely curved faces 81Cv and is retracted into abutment against the flat faces 81Cp.

In this fashion, the exhaust switching drive shaft 81 as it moves axially causes the first switching pin 83 and the second switching pin 84 to be alternately advanced and retracted.

As illustrated in FIG. 8, the intake cam switching mechanism 70 and the exhaust cam switching mechanism 80 are disposed closer to the crankshaft 10 than the central axis Ci of the intake camshaft 42 and the central axis Ce of the exhaust camshaft 52. The intake cam switching mechanism 70 is disposed between an intake plane Si that includes the central axis Ci of the intake camshaft 42 and lies parallel to the cylinder axis Lc and an exhaust plane Se that includes the central axis Ce of the exhaust camshaft 52 and lies parallel to the cylinder axis Lc.

As illustrated in FIGS. 1 and 4, an intake hydraulic actuator 77 for axially moving the intake switching drive shaft 71 is protrusively mounted on the right side wall 3R of the cylinder head 3, and an exhaust hydraulic actuator 87 for axially moving the exhaust switching drive shaft 81 is protrusively mounted on the right side wall 3R of the cylinder head 3 and arrayed behind the intake hydraulic actuator 77.

Movement of the intake cam switching mechanism 70 for moving the intake cam carrier 43 to cause the low-speed cam lobe 43A and the high-speed cam lobe 43B to selectively act on the intake rocker arms 72 will be described below with reference to FIG. 16.

Figure 16:
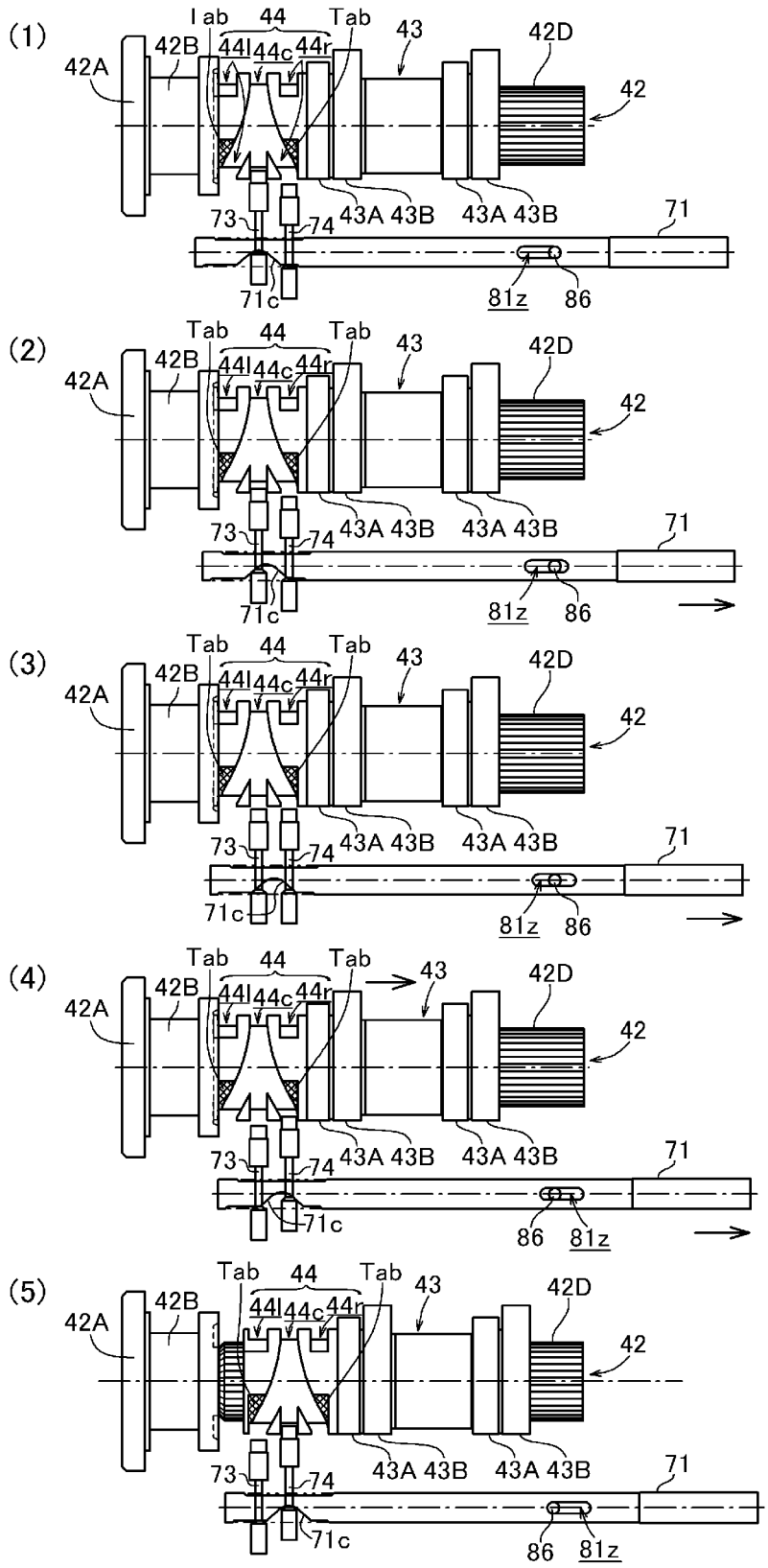
FIG. 16 is a view illustrating a chronological sequence of operation of major components of the intake cam switching mechanism.

FIG. 16 illustrates a chronological sequence of operation of major components of the intake cam switching mechanism 70.

FIG. 16 illustrates in (1) a state in which the intake cam carrier 43 is in a left position, causing the high-speed cam lobes 43B to act on the intake rocker arms 72 to operate the intake valves 41 according to valve operating characteristics set by the cam profile of the high-speed cam lobes 43B.

At this time, the intake switching drive shaft 71 is also in a left position in which the concavely curved faces 71Cv of the cam surface 71C are positioned at the first switching pin 73 and the first switching pin 73 is in the advanced position abutting against the concavely curved faces 71Cv and engaging in the steady lead groove 44*c* of the lead groove tubular portion 43D of the intake cam carrier 43.

The second switching pin 74 is retracted in abutment against the flat faces 71Cp of the cam surface 71C, and is spaced from the lead groove 44.

Therefore, since the first switching pin 73 engages in the steady lead groove 44*c* that is defined fully circumferentially in the intake cam carrier 43, the intake cam carrier 43 that is splined to the intake camshaft 42 and is rotating is not moved axially, but is kept in a predetermined position.

When the intake switching drive shaft 71 is then moved to the right from this state by the intake hydraulic actuator 77, the first switching pin 73 is retracted by being guided by the slanted surfaces of the concavely curved faces 71Cv and the second switching pin 74 is advanced by being guided from the flat faces 71Cp to the slanted surfaces of the concavely curved faces 71Cv (see (2) in FIG. 16). The first switching pin 73 and the second switching pin 74 are spaced substantially the same distances from the lead groove 44 (see (3) in FIG. 16). Then, rather than the first switching pin 73 being retracted further in abutment against the flat faces 71Cp, the second switching pin 74 is advanced further in abutment against the concavely curved faces 71Cv and engages into the right shift lead groove 44*r* in the lead groove tubular portion 53D (see (4) in FIG. 16).

When the second switching pin 74 engages in the right shift lead groove 44*r*, the intake cam carrier 43 is moved axially to the right while being guided by the right shift lead groove 44*r* and rotated (see (4) and (5) in FIG. 16).

When the intake cam carrier 43 is moved to the right, the second switching pin 74 engages into the steady lead groove 44*c*. The intake cam carrier 43 is thus kept in a predetermined position to which it has moved rightwardly (see (5) in FIG. 16). At this time, the low-speed cam lobs 43A, rather than the high-speed cam lobes 43B, act on the intake rocker arms 72 to operate the intake valves 41 according to valve operating characteristics set by the cam profile of the low-speed cam lobes 43A.

In this manner, when the intake switching drive shaft 71 is moved to the right, the high-speed cam lobes 43B change to the low-speed cam lobes 43A for acting on the intake valves 41.

Conversely, when the intake switching drive shaft 71 is then moved to the left from this state, the second switching pin 74 is retracted away from the steady lead groove 44*c*, and the first switching pin 73 is advanced into the left shift lead groove 441 and guided by the left shift lead groove 441 to move the intake cam carrier 43 to the left, whereupon the low-speed cam lobes 43A change to the high-speed cam lobes 43B for acting on the intake valves 41.

Movement of the exhaust cam switching mechanism 80 will next be described below with reference to FIG. 17.

Figure 17:
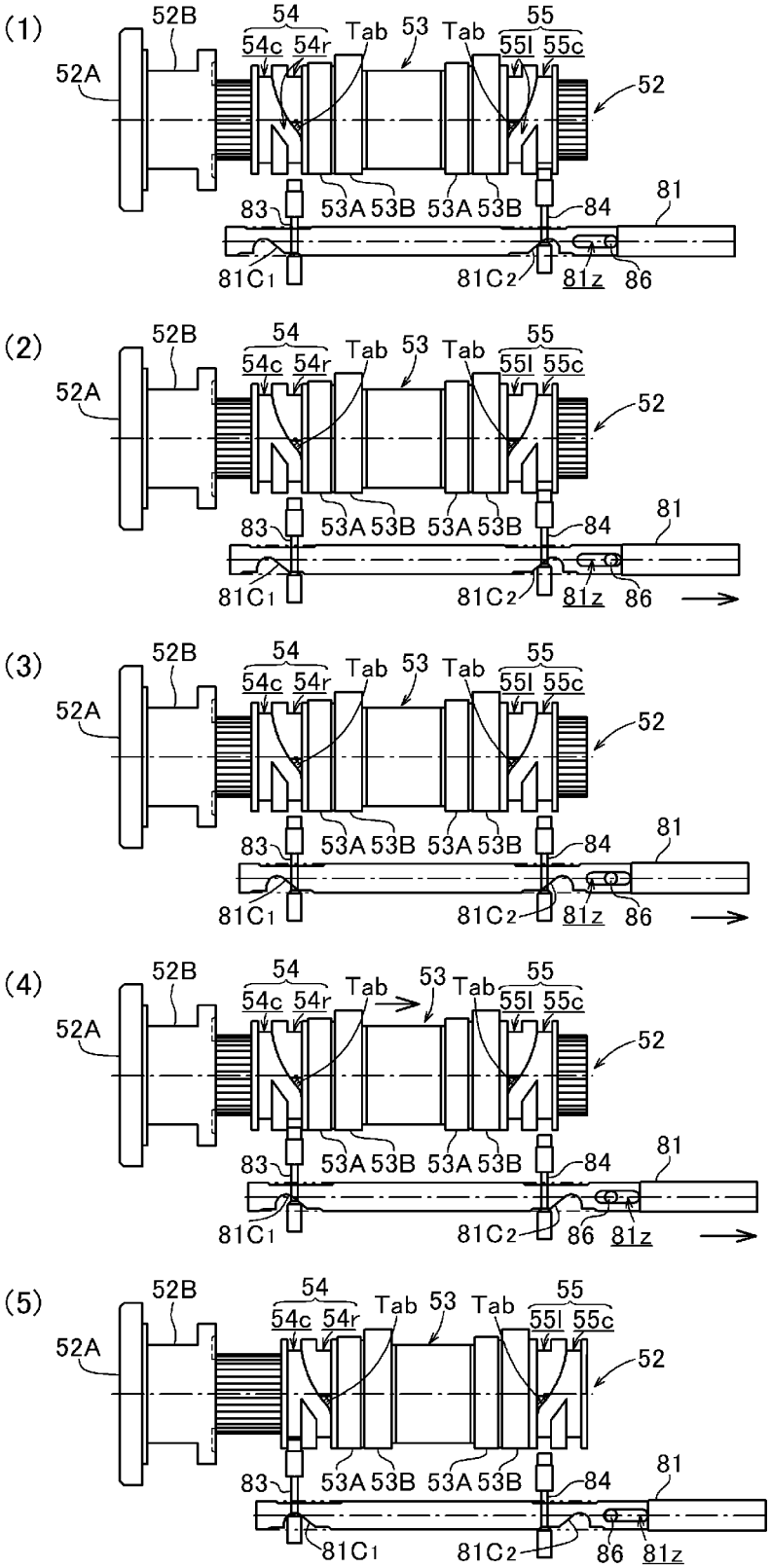
FIG. 17 is a view illustrating a chronological sequence of operation of major components of the exhaust cam switching mechanism.

FIG. 17 illustrates in (1) a state in which the exhaust cam carrier 53 is in a left position, causing the high-speed cam lobes 53B to act on the intake rocker arms 72 to operate the intake valves 41 according to valve operating characteristics set by the cam profile of the high-speed cam lobes 53B.

At this time, the exhaust switching drive shaft 81 is also in a left position in which the first switching pin 83 is retracted in abutment against the flat faces 81Cp of the left cam surface 81$C_1$ and spaced from the left lead groove 54, and the concavely curved faces 81Cv of the right cam surface 81$C_2$ are positioned at the second switching pin 84 and the second switching pin 84 is advanced in abutment against the concavely curved faces 81Cv and engaging in the steady lead groove 55*c* of the right lead groove 55 in the exhaust cam carrier 53, so that the exhaust cam carrier 53 is not moved axially, but is kept in a predetermined position.

When the exhaust switching drive shaft 81 is then moved to the right from this state by the exhaust hydraulic actuator 87, the second switching pin 84 is retracted by being guided by the slanted surfaces of the concavely curved faces 81Cv and the first switching pin 83 is advanced by being guided from the flat faces 81Cp by the slanted surfaces of the concavely curved faces 81Cv (see (2) in FIG. 17). The first switching pin 83 and the second switching pin 84 are spaced substantially the same distances from the lead grooves 54 and 55 (see (3) in FIG. 17). Then, rather than the second switching pin 84 being retracted further in abutment against the flat faces 81Cp, the first switching pin 83 is advanced further in abutment against the concavely curved faces 81Cv and engages into the right shift lead groove Mr of the left lead groove 54 (see (4) in FIG. 17).

When the first switching pin 83 engages in the right shift lead groove 54*r*, the exhaust cam carrier 53 is moved axially to the right while being guided by the right shift lead groove 54*r* and rotated (see (4) and (5) in FIG. 17).

When the exhaust cam carrier 53 is moved to the right, the first switching pin 83 engages into the steady lead groove 54*c*. The exhaust cam carrier 53 is thus kept in a predetermined position to which it has moved rightwardly (see (5) in FIG. 17). At this time, the low-speed cam lobes 53A, rather than the high-speed cam lobes 53B, act on the exhaust rocker arms 82 to operate the exhaust valves 51 according to valve operating characteristics set by the cam profile of the low-speed cam lobes 53A.

In this manner, when the exhaust switching drive shaft 81 is moved to the right, the high-speed cam lobes 53B change to the low-speed cam lobes 53A for acting on the exhaust valves 51.

Conversely, when the exhaust switching drive shaft 81 is then moved to the left from this state, the first switching pin 83 and the second switching pin 84 are retracted away from the steady lead groove Mc, and the second switching pin 84 is advanced into the left shift lead groove 551 and guided by the left shift lead groove 551 to move the exhaust cam carrier 53 to the left, whereupon the low-speed cam lobes 43A change to the high-speed cam lobes 43B for acting on the exhaust valves 51.

Figure 18:
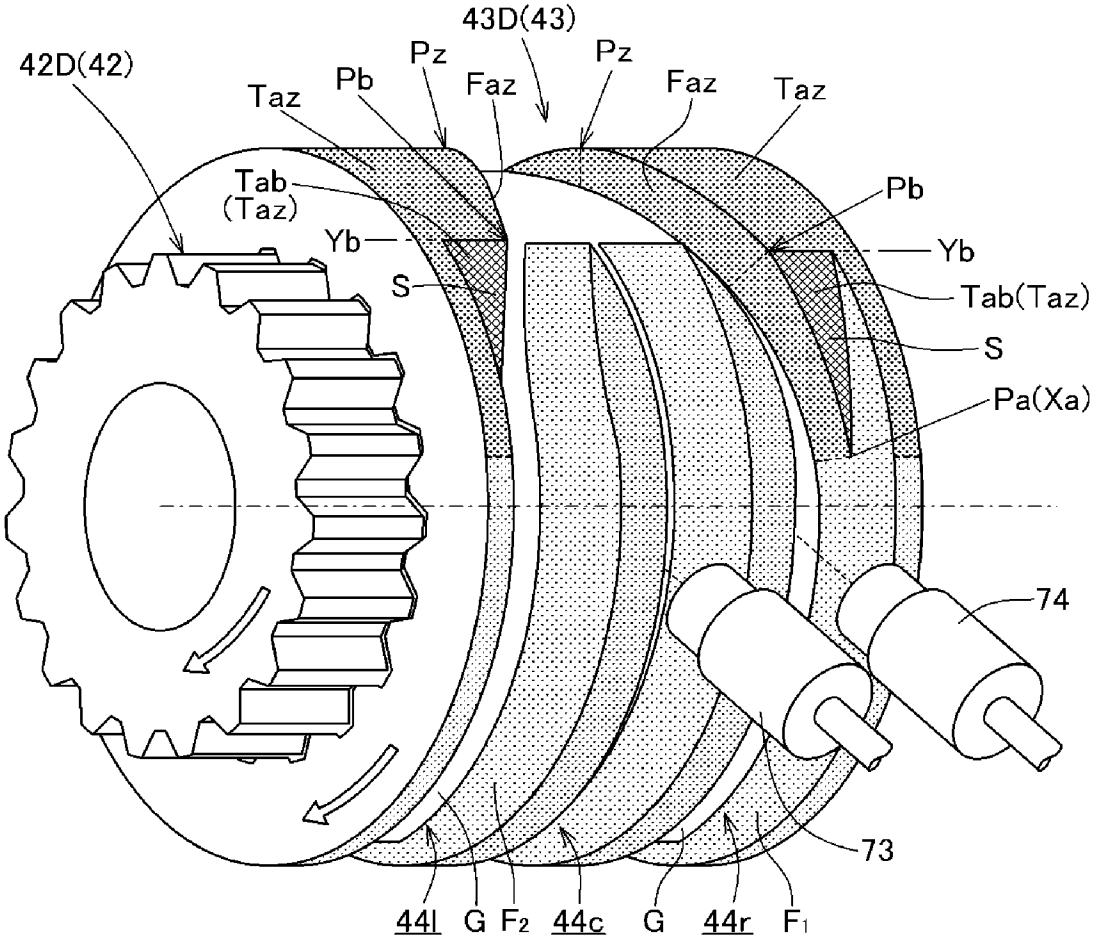
FIG. 18 is an enlarged perspective view of a lead groove tubular portion of an intake cam carrier together with a splined shaft portion of an intake camshaft.

In the variable valve operating device 40, as illustrated in FIG. 18, shift groove side walls Taz of the shift lead grooves 441 and 44*r* defined in the lead groove tubular portion 43D of the intake cam carrier 43 and the shift lead grooves 551 and 54*r* defined in the lead groove tubular portions 53D and 53E of the exhaust cam carrier 53 include particular shift groove side walls Tab.

FIG. 18 is an enlarged perspective view of an essential part of the lead groove tubular portion 43D of the intake cam carrier 43 together with the splined shaft portion 42D of the intake camshaft 42.

The lead groove tubular portion 43D includes the annular steady lead groove 44*c* disposed in a fixed axial position and extending fully circumferentially, and the left shift lead groove 441 and the right shift lead groove 44*r* that are branched respectively leftwardly and rightwardly from the steady lead groove 44*c* and extend spirally to respective positions that are axially spaced leftwardly and rightwardly by predetermined distances in the circumferential directions.

The shift lead grooves 441 and 44*r* are in the form of channels defined by groove bottom surfaces G and groove side wall surfaces $F_1$ and $F_2$ on both sides of the groove bottom surfaces G.

Figure 19:
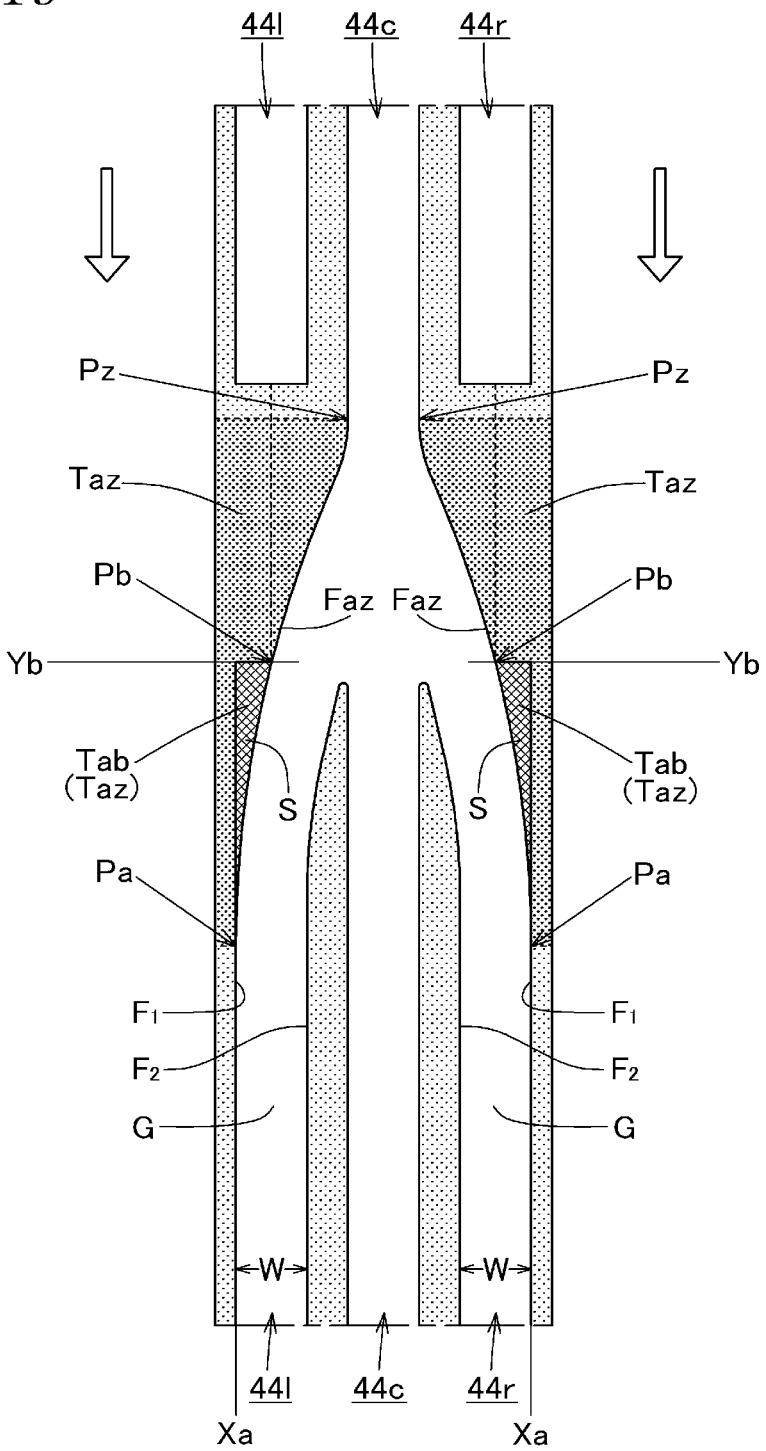
FIG. 19 is a development view of a lead groove defined in the lead groove tubular portion of the intake cam carrier.

FIG. 19 is a development view of the lead groove 44 (the left shift lead groove 441, the steady lead groove 44*c*, and the right shift lead groove 44*r*) in the lead groove tubular portion 43D.

Referring to FIGS. 18 and 19, of the groove side wall surfaces $F_1$ and $F_2$ of the left shift lead groove 441, the groove side wall surface $F_1$ that is pressed by the first switching pin 73 held in sliding contact therewith, and the groove side wall surface $F_1$ of the right shift lead groove 44*r* that is pressed by the second switching pin 74 held in sliding contact therewith include respective shift groove side wall surfaces Faz on which a shifting action operates from shift starting inflection regions Pa where the intake cam carrier 43 starts its shifting movement by the switching pins 73 and 74 to shift ending inflection regions Pz where the intake cam carrier 43 ends its shifting movement.

The shift lead grooves 441 and 44*r* are joined to the steady lead groove 44*c* at the shift ending inflection regions Pz.

Referring to FIG. 19, the shift groove side walls Taz (illustrated densely stippled in FIG. 19) that have the shift groove side wall surfaces Faz as their wall surfaces on the lead groove tubular portion 43D include the particular shift groove side walls Tab (illustrated cross-hatched in FIG. 19). The particular shift groove side walls Tab are generally in the shape of right-angled triangles extending axially from axial positions Xa of the shift starting inflection regions Pa toward the shift groove side wall surfaces Faz and also extending circumferentially from circumferential positions Yb of shift intermediate regions Pb from the shift starting inflection regions Pa to the shift ending inflection regions Pz on the shift groove side wall surfaces Faz toward the shift groove side wall surfaces Faz. The particular shift groove side walls Tab have slanted outer circumferential surfaces S extending circumferentially from the circumferential positions Yb of the shift intermediate regions Pb progressively deeper toward the bottoms of the lead grooves and reaching the shift starting inflection regions Pa.

Figure 20:
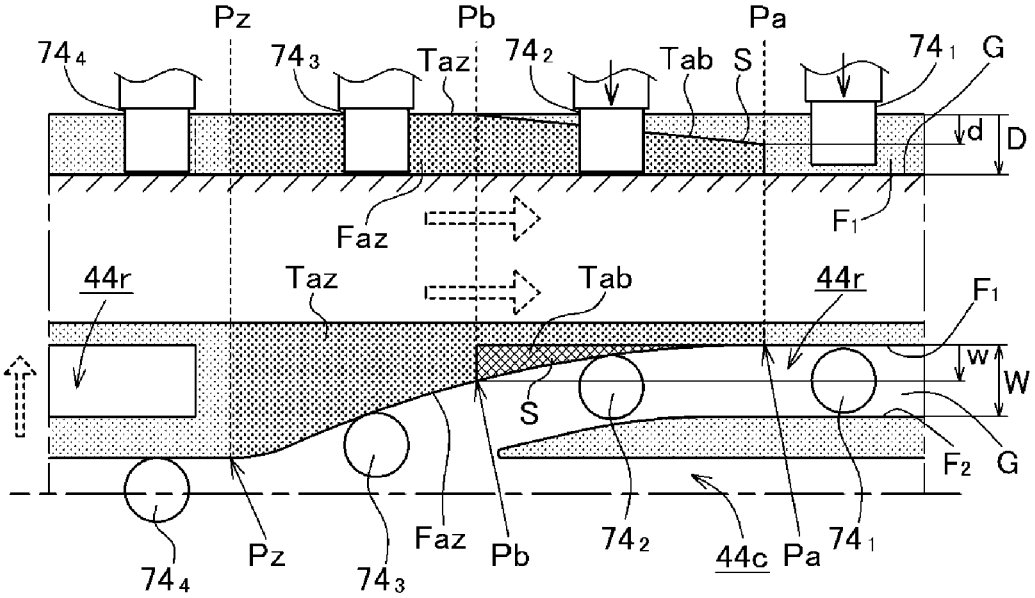
FIG. 20 is a view illustrating a chronological sequence of movement of a switching pin when the switching pin has deeply entered a shift lead groove immediately before it hits and contacts a shift groove side wall.

As illustrated in FIG. 20, each of the shift intermediate regions Pb is disposed in an axial position that is axially spaced from the shift starting inflection region Pa by a distance w that is equal to or larger than one-half of the lead groove width W of the shift lead groove 44 ($w \geq W/2$).

As illustrated in FIG. 20, the depth d of each of the slanted outer circumferential surfaces S at the shift starting inflection region Pa from the outer circumferential surface of the lead groove tubular portion 43D is equal to or larger than about one-half of the depth D of the lead groove. In other words, the depth d at the shift starting inflection region Pa is $d \geq D/2$.

The particular shift groove side walls Tab are shaped substantially in bilateral symmetry in both of the left shift lead groove 441 and the right shift lead groove 44*r* (see FIGS. 4, 5, and 19).

The shift groove side walls Taz of the shift lead grooves 54*r* and 551 in the lead groove tubular portions 53D and 53E of the exhaust cam carrier 53 include similar particular shift groove side walls Tab (see FIGS. 4 and 5).

Operation of the particular shift groove side walls Tab that have the slanted outer circumferential surfaces S will be described below with reference to FIGS. 20 and 21 with regard to the above sequence of operation illustrated in FIG. 16 in which the second switching pin 74 engages in the right shift lead groove 44*r* to move the intake cam carrier 43 axially to the right.

Figure 21:
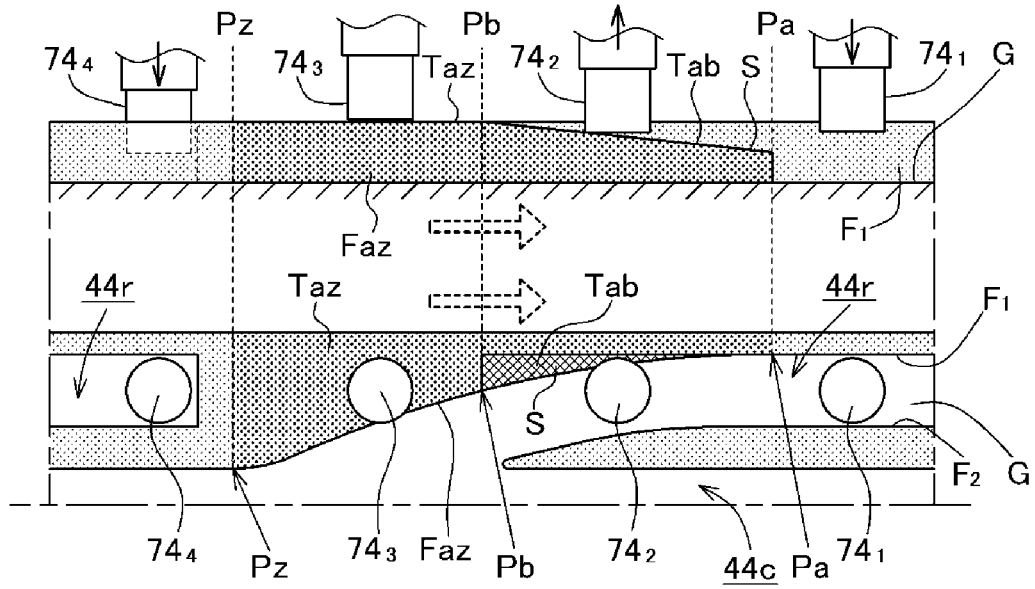
FIG. 21 is a view illustrating a chronological sequence of movement of a switching pin when the switching pin has slightly entered a shift lead groove immediately before it hits and contacts a shift groove side wall.

FIGS. 20 and 21 are a side elevational view and a plan view, respectively, as linear development views, of the shift groove side wall surface Faz and the shift groove side wall Taz that are pressed mainly by the second switching pin 74 held in sliding contact therewith, in the right shift lead groove 44 in the lead groove tubular portion 43D. FIGS. 20 and 21 illustrate the shift groove side wall surface Faz and the shift groove side wall Taz in aligned angular positions, and also illustrate the relative positional relationship between the right shift lead groove 44*r* and the second switching pin 74 such that the intake cam carrier 43 is fixed against rotation and axial movement whereas the second switching pin 74 is turned and axially moved.

Actually, the intake cam carrier 43 is rotated and axially moved in the directions indicated by the broken-line outline arrows in FIGS. 20 and 21.

FIG. 20 illustrates the second switching pin 74 when it has moved at suitable time intervals to different positions, simultaneously as second switching pins $\mathbf{74}_1$, $\mathbf{74}_2$, $\mathbf{74}_3$, and $\mathbf{74}_4$ at the respective positions during a process in which the second switching pin 74 that has traveled moves sufficiently into the right shift lead groove 44*r* and thereafter the shift starting inflection region Pa of the shift groove side wall surface Faz of the particular shift groove side wall Tab that is rotating reaches the second switching pin 74.

As illustrated in FIG. 20, immediately before the shift starting inflection region Pa reaches the second switching pin 74, the second switching pin $\mathbf{74}_1$ has sufficiently entered the right shift lead groove 44*r*, i.e., the second switching pin $\mathbf{74}_1$ has entered the right shift lead groove 44*r* to a depth larger than the depth d of the slanted outer circumferential surface S at the shift starting inflection region Pa from the outer circumferential surface of the lead groove tubular portion 43D.

Consequently, at a next time interval, the second switching pin $\mathbf{74}_2$ impinges upon the shift groove side wall surface Faz of the particular shift groove side wall Tab. Immediately after the second switching pin $\mathbf{74}_2$ has impinged upon the shift groove side wall surface Faz, since the particular shift groove side wall Tab has the slanted outer circumferential surface S in addition to the movement of the second switching pin $\mathbf{74}_2$, the area of sliding contact of the second switching pin $\mathbf{74}_2$ with the shift groove side wall surface Faz quickly increases. Therefore, no undue intensive load is imposed on the distal end of the switching pin, so that the load on the second switching pin $\mathbf{74}_2$ may be small and the second switching pin $\mathbf{74}_2$ is prevented from behaving undesirably, e.g., from being flicked off.

As the shift groove side wall surface Faz slidingly contacts the second switching pin $\mathbf{74}_2$ while the second switching pin $\mathbf{74}_2$ is kept in a stable state free of undue stress, the intake cam carrier 43 is smoothly guided axially while rotating about its own axis.

At a next time interval, the shift groove side wall surface Faz slidingly contacts the second switching pin $\mathbf{74}_3$ while sufficiently keeping its area of sliding contact therewith, and the intake cam carrier 43 is guided axially while rotating about its own axis, making smooth axial shifting movement while the load on the second switching pin $\mathbf{74}_3$ is being kept at a low level.

At a next time interval, the shift ending inflection region Pz moves past the second switching pin $\mathbf{74}_3$, and the second switching pin $\mathbf{74}_4$ enters the steady lead groove 44*c*. The right shifting movement of the intake cam carrier 43 is now completed, causing the high-speed cam lobes 43B to be switched to the low-speed cam lobes 43A for acting on the intake valves 41.

FIG. 21 illustrates the manner in which the second switching pin 74 has slightly entered a shift lead groove. FIG. 21 illustrates the second switching pin 74 as it has traveled and slightly moved into the right shift lead groove 44*r* whereupon the shift starting inflection region Pa of the shift groove side wall surface Faz of the particular shift groove side wall Tab that is rotating reaches the second switching pin 74.

In FIG. 21, immediately before the shift starting inflection region Pa reaches the second switching pin $\mathbf{74}_1$, the second switching pin $\mathbf{74}_1$ has slightly entered the right shift lead groove 44*r*, i.e., when the shift starting inflection region Pa reaches the second switching pin $\mathbf{74}_1$, the second switching pin $\mathbf{74}_1$ has slightly entered the right shift lead groove 44*r* to a depth smaller than the depth d of the tip end of the slanted outer circumferential surface S at the shift starting inflection region Pa from the outer circumferential surface of the lead groove tubular portion 43D. At a next time interval, the distal end of the second switching pin $\mathbf{74}_2$ is positioned along a plane axially perpendicular to the axial position Xa of the shift starting inflection region Pa on the shift groove side wall Taz that is rotating, but does not impinge upon the shift groove side wall surface Faz. Instead, the second switching pin $\mathbf{74}_2$ is brought into sliding contact with the slanted outer circumferential surface S of the particular shift groove side wall Tab. The second switching pin $\mathbf{74}_2$ is not moved to the left or right, but is retracted against the spring 75 and slides up the slanted outer circumferential surface S.

At a next time interval, the second switching pin $74_3$ is transferred onto the outer circumferential surface of the lead groove tubular portion 43D. At a next time interval, the second switching pin $74_4$ rides over the outer circumferential surface of the lead groove tubular portion 43D and then enters the right shift lead groove 44*r* again under the bias of the spring 75.

Therefore, in a next cycle, when the second switching pin $74_4$ has sufficiently entered the right shift lead groove 44*r*, the shift starting inflection region Pa reaches the switching pin, causing the intake cam carrier 43 to be shifted smoothly to the right through the sequence illustrated in FIG. 20.

Consequently, since the distal end of the switching pin 74 does not impinge upon the shift groove side wall surface Faz, but is brought into sliding contact with the slanted outer circumferential surface of the particular shift groove side wall Tab under the bias of the spring 75, no undue intensive load is imposed on the distal end of the second switching pin 74, so that the load on the second switching pin 74 is small.

As illustrated in FIGS. 20 and 21, irrespectively of the timing at which the second switching pin 74 enters the right shift lead groove 44*r* in the intake cam carrier 43, the load on the second switching pin 74 is small at all times, making it possible to shift the intake cam carrier 43 smoothly to the right.

Inasmuch as the left shift lead groove 441 and the right shift lead groove 44*r* do not have respective steady lead grooves, but the single steady lead groove 44*c* is juxtaposed between the left shift lead groove 441 and the right shift lead groove 44*r*, the axial width of the lead groove tubular portion 43D is minimized to prevent the cam carrier 43 from increasing in size.

Because the shift intermediate region Pb is in an axial position that is axially spaced from the shift starting inflection region Pa by a distance that is equal to or larger than about one-half of the lead groove width W of the right shift lead groove 44*r*, the axial width of the slanted outer circumferential surface S, which is shaped generally as a right-angled triangle, of the particular shift groove side wall Tab is progressively increased to a width that is equal to or larger than about one-half of the lead groove width W, reducing the possibility that the second switching pin 74 that has moved onto the slanted outer circumferential surface S may fall off the slanted outer circumferential surface S. Thus, it is possible to avoid, as much as possible, an intensive load that would otherwise be applied to the edge of the distal end of the second switching pin 74 if the second switching pin 74 falls off the slanted outer circumferential surface S, thereby reducing the load on the second switching pin 74.

As the depth d of the shift starting inflection region Pa on the slanted outer circumferential surface S from the outer circumferential surface of the lead groove tubular portion 43D is equal to or larger than the lead groove depth D, the angle at which the slanted outer circumferential surface S of the particular shift groove side wall Tab is slanted can easily be set to a large value. Therefore, when the shift starting inflection region Pa of the shift groove side wall surface Faz of the shift lead groove that is rotating has reached the second switching pin 74, even if the shift groove side wall surface Faz impinges upon the distal end of the switching pin, since the slanted outer circumferential surface S of the particular shift groove side wall Tab is steeply slanted in addition to the movement of the second switching pin 74 immediately after the shift groove side wall surface Faz has impinged upon the distal end of the switching pin, the area of sliding contact of the second switching pin 74 with the shift groove side wall surface Faz is quickly increased, so that the load on the second switching pin may be reduced.

The operation and effects of the particular shift groove side wall Tab that has the slanted outer circumferential surface S at the time the second switching pin 74 engages in the right shift lead groove 44*r* to move the intake cam carrier 43 axially to the right has been described above. When the first switching pin 73 engages in the left shift lead groove 441 to move the intake cam carrier 43 axially to the left, the particular shift groove side wall Tab of the shift groove side wall Taz of the left shift lead groove 441 operates in the similar manner and has the similar effects as described above.

Furthermore, for shifting the exhaust cam carrier 53, the particular shift groove side walls Tab of the shift groove side walls Taz of the shift lead grooves Mr and 551 also operate in the similar manner and have the similar effects as described above.

The intake cam carrier 43 is arranged such that the shift groove side wall surfaces Faz slidingly contact the switching pins 73 and 74 to shift the intake cam carrier 43 in an angular range thereof where the common base circle of the low-speed cam lobes 43A and the high-speed cam lobes 43B which have different cam profiles act on the intake valves 41.

Therefore, while the common base circle of the low-speed cam lobes 43A and the high-speed cam lobes 43B is acting on the intake valves 41, the intake cam carrier 43 can be shifted without fail.

The exhaust cam carrier 53 is also similarly arranged.

A lead groove tubular portion of a cam carrier according to a modification will be described below with reference to FIG. 22.

Figure 22:
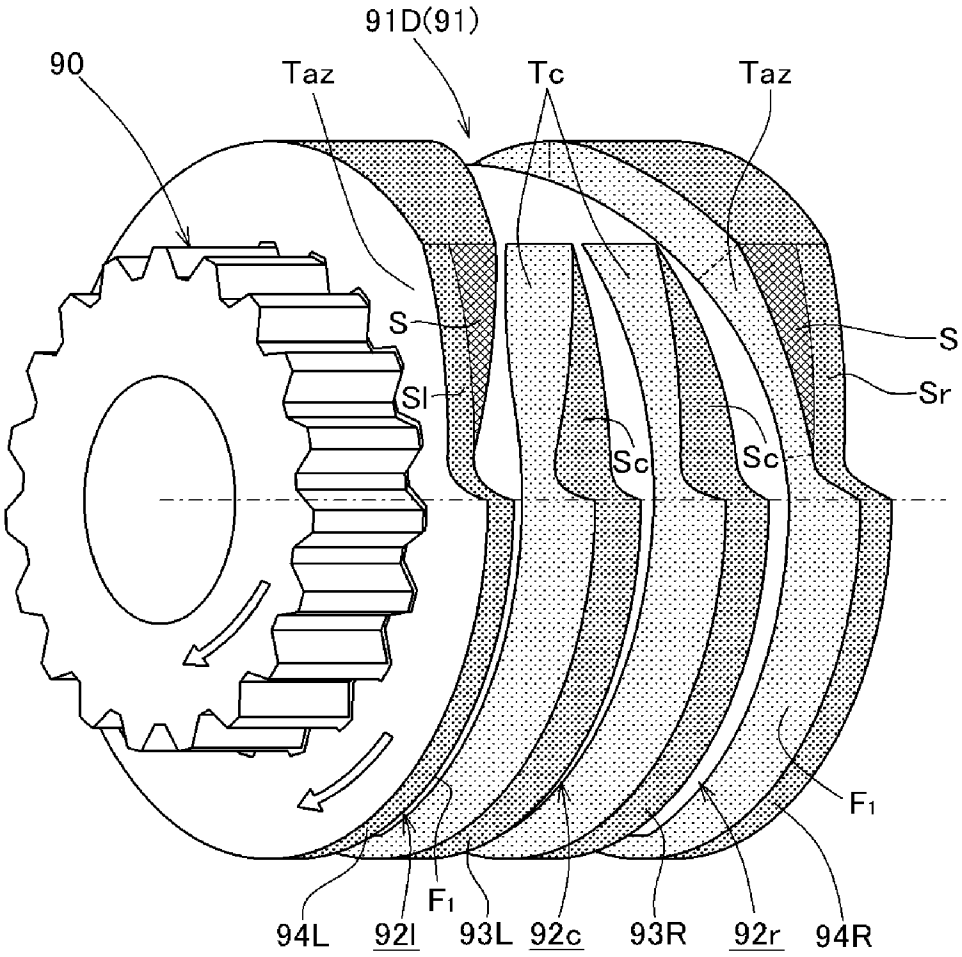
FIG. 22 is a perspective view of an essential part of a lead groove tubular portion of a cam carrier according to a modification.

FIG. 22 illustrates only a lead groove tubular portion 91D of a cam carrier 91 that is slidably fitted over a camshaft 90. As with the intake cam carrier 43, the lead groove tubular portion 91D includes a steady lead groove 92*c* and a left shift lead groove 921 and a right shift lead groove 92*r* that are branched respectively leftwardly and rightwardly from the steady lead groove 92*c*. The lead groove tubular portion 91D also includes particular shift groove side walls Tab (illustrated cross-hatched in FIG. 22) having slanted outer circumferential surfaces S, on shift groove side walls Taz of the shift lead grooves 921 and 92*r*.

The lead groove tubular portion 91D illustrated in FIG. 22 includes a left side wall 94L having a groove side wall surface $F_1$ which is pressed by a first switching pin in sliding contact therewith, of groove side wall surfaces $F_1$ and $F_2$ of the left shift lead groove 921, a right side wall 94R having a groove side wall surface $F_1$ which is pressed by a second switching pin in sliding contact therewith, of groove side wall surfaces $F_1$ and $F_2$ of the right shift lead groove 92*r*, and side walls 93 and, 93R on both sides of the steady lead groove 92*c*, the side walls being simultaneously formed by cutting operation.

The side walls 93L and 93R that define the steady lead groove 92*c* include respective distal-end side walls Tc that are tapered. The distal-end side walls Tc and the left and right side walls 94L and 94R on both sides have slanted outer circumferential surfaces Sc, Sc, Sl, and Sr that lie flush with the slanted outer circumferential surface S of the particular shift groove side walls Tab.

The slanted outer circumferential surfaces S of the outer particular shift groove side walls Tab of the left and right shift lead grooves 441 and 44*r* and the slanted outer circumferential surfaces Sc of the inner distal-end side walls Tc of the left and right shift lead grooves 441 and 44*r* are disposed in the same circumferential position on the lead groove tubular portion 91D and lie flush with each other. The four slanted outer circumferential surfaces S, S, Sc, and Sc can simultaneously be cut by a single cutting tool.

In other words, it is easy to simultaneously cut the slanted outer circumferential surfaces S of the particular shift groove side walls Tab with a single cutting tool, resulting in a reduction in the manufacturing cost.

While the variable valve operating device according to the embodiment of the present invention has been described above, the present invention is not limited to the above embodiment, but covers various changes, features, and aspects within the scope of the invention.

REFERENCE SIGNS LIST

E . . . Internal combustion engine, M . . . Transmission, 3 . . . Cylinder head, 3A, 3B . . . Tubular member, 3*c* . . . Valve operating chamber,

40 . . . Variable valve operating device,

41 . . . Intake valve, 42 . . . Intake camshaft, 42A . . . Left flange, 42B . . . Journal, 42C . . . Right flange, 42D . . . Splined shaft portion,

43 . . . Intake cam carrier, 43A . . . Low-speed cam lobe, 43B . . . High-speed cam lobe, 43C . . . Bearing-borne tubular journal, 43D . . . Lead groove tubular portion, 43E . . . Right end tubular portion, 44 . . . Lead groove, 44*c* . . . Steady lead groove, 441 . . . Left shift lead groove, 44*r* . . . Right shift lead groove,

51 . . . Exhaust valve, 52 . . . Exhaust camshaft, 52A . . . Left flange, 52B . . . Journal, 52C . . . Right flange, 52D . . . Splined shaft portion,

53 . . . Exhaust cam carrier, 53A . . . Low-speed cam lobe, 53B . . . High-speed cam lobe, 53C . . . Bearing-borne tubular journal, 53D . . . Lead groove tubular portion, 53E . . . Lead groove tubular portion, 54 . . . Left lead groove, 54*c* . . . Steady lead groove, 54*r* . . . Right shift lead groove 55 . . . Right lead groove, 55*c* . . . Steady lead groove, 551 . . . Left shift lead groove,

70 . . . Intake cam switching mechanism, 71 . . . Intake switching drive shaft, 71C . . . Cam surface, 72 . . . Intake rocker arm, 73 . . . First switching pin, 74 . . . Second switching pin, 75 . . . Helical spring, Ca . . . Linear-motion cam mechanism,

80 . . . Exhaust cam switching mechanism, 81 . . . Exhaust switching drive shaft, 81$C_1$, 81$C_2$ . . . Cam surface, 82 . . . Exhaust rocker arm, 83 . . . First switching pin, 84 . . . Second switching pin, 85 . . . Helical spring, Cb, Cc . . . Linear-motion cam mechanism, Faz . . . Shift groove side wall surface, Pa . . . Shift starting inflection region, Pb Shift intermediate region, Pz . . . Shift ending inflection region, Taz . . . Shift groove side wall, Tab . . . Particular shift groove side wall, S . . . Slanted outer circumferential surface,

90 . . . Camshaft, 91 . . . Cam carrier, 91D . . . Lead groove tubular portion, 92*c* . . . Steady lead groove, 911 . . . Left shift lead groove, 92*r* . . . Right shift lead groove, 93L, 93R . . . Side wall, 94L . . . Left side wall, 94R . . . Right side wall, Tc Distal-end side wall, Sc Slanted outer circumferential surface.

The invention claimed is:

1. A variable valve operating device for an internal combustion engine, comprising:

a camshaft rotatably supported in a cylinder head of the internal combustion engine;

a cam carrier in the form of a tubular member axially movably, but relatively nonrotatably fitted over an outer circumferential surface of the camshaft, the cam carrier having a lead groove tubular portion integrally therewith which has on an outer circumferential surface a plurality of cam lobes having different cam profiles and disposed axially adjacent to each other and shift lead grooves in the form of channels defined by groove bottom surfaces and groove side wall surfaces on both sides of the groove bottom surfaces;

switching pins that can be advanced into and retracted out of the shift lead grooves; and a cam switching mechanism for axially guiding and shifting the cam carrier while the cam carrier is rotating to switch between the cam lobes for acting on valves of the internal combustion engine when the switching pins are advanced under the bias of springs to engage into the shift lead grooves, wherein, of the shift lead grooves in the lead groove tubular portion, the groove side wall surfaces that are pressed by the switching pins include shift groove side wall surfaces from shift starting inflection regions where the cam carrier starts its shifting movement to shift ending inflection regions where the cam carrier ends its shifting movement, shift intermediate regions are disposed in predetermined regions from the shift starting inflection regions to the shift ending inflection regions on the shift groove side wall surfaces, the lead groove tubular portion includes shift groove side walls having the shift groove side wall surfaces as wall surfaces thereof circumferentially between the shift starting inflection regions and the shift ending inflection regions, the shift groove side walls include particular shift groove side walls disposed in an area extending axially from axial positions of the shift starting inflection regions toward the shift intermediate regions and also extending circumferentially from circumferential positions of the shift intermediate regions toward the shift starting inflection regions, and the particular shift groove side walls have slanted outer circumferential surfaces extending circumferentially from the circumferential positions of the shift intermediate regions progressively deeper toward the groove bottom surfaces and reaching the shift starting inflection regions.

2. The variable valve operating device for an internal combustion engine of claim 1, wherein the lead groove tubular portion of the cam carrier has a steady lead groove disposed in a fixed axial position and extending fully circumferentially, the steady lead groove being arrayed axially adjacent to the shift lead grooves, and the shift lead grooves are joined to the steady lead groove at the shift ending inflection regions.

3. The variable valve operating device for an internal combustion engine as claimed in claim 1, wherein the shift intermediate regions are disposed in an axial position that is axially spaced from the shift starting inflection regions by a distance that is equal to or larger than one-half of the lead groove width of the shift lead grooves.

4. The variable valve operating device for an internal combustion engine as claimed in claim 1, wherein a depth of the slanted outer circumferential surfaces at the shift starting inflection regions from the outer circumferential surface of the lead groove tubular portion is equal to or larger than one-half of the lead groove depth.

5. The variable valve operating device for an internal combustion engine as claimed in claim 1, wherein the shift groove side wall surfaces are disposed on the lead groove tubular portion for slidingly contacting the switching pins in an angular range of the cam carrier where the common base circle of the cam lobes which have different cam profiles act on the valve.

6. The variable valve operating device for an internal combustion engine as claimed in claim 2, wherein the shift intermediate regions are disposed in an axial position that is axially spaced from the shift starting inflection regions by a distance that is equal to or larger than one-half of the lead groove width of the shift lead grooves.

7. The variable valve operating device for an internal combustion engine as claimed in claim 2, wherein a depth of the slanted outer circumferential surfaces at the shift starting inflection regions from the outer circumferential surface of the lead groove tubular portion is equal to or larger than one-half of the lead groove depth.

8. The variable valve operating device for an internal combustion engine as claimed in claim 3, wherein a depth of the slanted outer circumferential surfaces at the shift starting inflection regions from the outer circumferential surface of the lead groove tubular portion is equal to or larger than one-half of the lead groove depth.

9. The variable valve operating device for an internal combustion engine as claimed in claim 2, wherein the shift groove side wall surfaces are disposed on the lead groove tubular portion for slidingly contacting the switching pins in an angular range of the cam carrier where the common base circle of the cam lobes which have different cam profiles act on the valve.

10. The variable valve operating device for an internal combustion engine as claimed in claim 3, wherein the shift groove side wall surfaces are disposed on the lead groove tubular portion for slidingly contacting the switching pins in an angular range of the cam carrier where the common base circle of the cam lobes which have different cam profiles act on the valve.

11. The variable valve operating device for an internal combustion engine as claimed in claim 4, wherein the shift groove side wall surfaces are disposed on the lead groove tubular portion for slidingly contacting the switching pins in an angular range of the cam carrier where the common base circle of the cam lobes which have different cam profiles act on the valve.

* * * * *